US006714232B2

(12) United States Patent
Kerr et al.

(10) Patent No.: US 6,714,232 B2
(45) Date of Patent: Mar. 30, 2004

(54) IMAGE PRODUCING PROCESS AND APPARATUS WITH MAGNETIC LOAD ROLLER

(75) Inventors: Roger S. Kerr, Brockport, NY (US); Steven R. Lippold, Oakfield, NY (US)

(73) Assignee: Eastman Kodak Company, Rochester, NY (US)

( * ) Notice: Subject to any disclaimer, the term of this patent is extended or adjusted under 35 U.S.C. 154(b) by 252 days.

(21) Appl. No.: 09/942,894

(22) Filed: Aug. 30, 2001

(65) Prior Publication Data

US 2003/0043258 A1 Mar. 6, 2003

(51) Int. Cl.[7] ..... B41J 2/435
(52) U.S. Cl. ..... 347/262; 347/264
(58) Field of Search ..... 347/262, 264, 347/218, 220, 197, 215; 100/163 R

(56) References Cited

U.S. PATENT DOCUMENTS

| | | | | | |
|---|---|---|---|---|---|
| 5,053,791 | A | * | 10/1991 | Baek et al. | 347/233 |
| 5,164,742 | A | * | 11/1992 | Baek et al. | 347/234 |
| 5,168,288 | A | * | 12/1992 | Baek et al. | 347/240 |
| 5,175,564 | A | * | 12/1992 | Jamzadeh | 347/116 |
| 5,214,444 | A | * | 5/1993 | Kerr et al. | 347/238 |
| 5,260,714 | A | * | 11/1993 | DeCook et al. | 347/264 |
| 5,268,708 | A | * | 12/1993 | Harshbarger et al. | 346/134 |
| 5,270,731 | A | * | 12/1993 | Kerr et al. | 347/264 |
| 5,276,464 | A | * | 1/1994 | Kerr et al. | 346/134 |
| 5,301,099 | A | * | 4/1994 | Kerr | 347/139 |
| 5,323,180 | A | * | 6/1994 | Kuberka et al. | 347/215 |
| 5,341,159 | A | * | 8/1994 | Kerr | 347/139 |
| 5,376,954 | A | * | 12/1994 | Kerr | 346/138 |
| 5,392,702 | A | * | 2/1995 | Suzuki | 100/163 R |
| 5,446,477 | A | * | 8/1995 | Baek et al. | 347/215 |
| 5,777,658 | A | * | 7/1998 | Kerr et al. | 347/215 |
| 6,002,419 | A | * | 12/1999 | Kerr et al. | 347/233 |
| 6,014,162 | A | * | 1/2000 | Kerr et al. | 347/262 |
| 6,037,960 | A | * | 3/2000 | Kerr et al. | 347/172 |

FOREIGN PATENT DOCUMENTS

| | | | | |
|---|---|---|---|---|
| JP | 2-136871 | * | 5/1990 | G03G/15/00 |

* cited by examiner

*Primary Examiner*—Hai Pham
(74) *Attorney, Agent, or Firm*—The Harleston Law Firm, LLC

(57) ABSTRACT

An image processing apparatus (10) includes: a) a rotatable, magnet-attracting imaging drum (300) arranged to mount a receiver sheet (32) and a donor sheet (36) in superposed relationship; b) a motor (258) for rotating the imaging drum; c) a sheet transport assembly (91); d) a printhead (500); e) a lead screw (250) for moving the printhead; f) a linear translation subsystem (210); and g) a magnetic load roller (350) for eliminating entrained air. Also, an image producing process herein includes the steps of: a) rotating an imaging drum (300) in a first direction; b) driving a sheet of thermal print media (32) to the imaging drum (300) until a leading edge of the thermal print media sheet (32) engages the imaging drum (300); c) rotating the imaging drum (300) in a second direction of rotation; d) moving a magnetic load roller (350) into engagement with the leading edge of the thermal print media sheet (32); e) rotating the imaging drum (300) in a second direction until a trailing edge of the thermal print media sheet (32) is under the magnetic load roller (350); and f) moving the magnetic load roller (350) away from the imaging drum (300). These steps can be repeated for the donor material (36).

36 Claims, 21 Drawing Sheets

LOADING SEQUENCE

| SEQUENCE NUMBER | DRUM FLAT ℄ POSITION | DIRECTION OF ROTATION | VACUUM RECEIVER | VACUUM DONOR | LOAD ROLLER |
|---|---|---|---|---|---|
| 1 | HOME | ------ | ATSMR. | ATSMR. | DISENG. |
| 2 | H | C.W. | ATSMR. | ATSMR. | DISENG. |
| 3 | H | ------ | ATSMR. | ATSMR. | DISENG. |
| 4 | B | C.C.W. | ATSMR. | ATSMR. | DISENG. |
| 5 | B | ----- | VAC. | VAC. | DISENG. |
| 6 | B | ----- | VAC. | VAC. | ENG. |
| 7 | C | C.C.W. | VAC | VAC | ENG. |
| 8 | B | ----- | VAC. | VAC. | DISENG. |
| 9 | H | C.W. | VAC. | VAC. | DISENG. |
| 10 | H | ------ | VAC. | ATSMR. | DISENG. |
| 11 | H | ------ | VAC. | ATSMR. | DISENG. |
| 12 | H | ------ | VAC. | VAC. | DISENG. |
| 13 | H | ------ | VAC. | VAC. | ENG. |
| 14 | J | C.C.W. | VAC. | VAC. | ENG. |
| 15 | H | ------ | VAC. | VAC. | DISENG. |

FIG. 14a

DONOR UNLOADING SEQUENCE

| SEQUENCE NUMBER | DRUM FLAT ℄ POSITION | DIRECTION OF ROTATION | VACUUM RECEIVER | VACUUM DONOR | LOAD ROLLER | DONOR STRIPPER BLADE |
|---|---|---|---|---|---|---|
| 16 | F | ----- | VAC. | VAC. | DISENG. | DISENG. |
| 17 | F | ----- | VAC. | VAC. | ↓ | ENG. |
| 18 | F | ----- | ATSMR. | ATSMR. | | ENG. |
| 19 | E | C.C.W. | ATSMR. | ATSMR. | | ENG. |
| 20 | E | ----- | ATSMR. | ATSMR. | | DISENG. |
| 21 | E | ----- | VAC. | VAC. | | DISENG. |
| 22 | E | C.C.W. | VAC. | VAC. | | DISENG. |

FIG. 14b

RECEIVER UNLOADING SEQUENCE

| SEQUENCE NUMBER | DRUM FLAT ℄ POSITION | DIRECTION OF ROTATION | VACUUM RECEIVER | VACUUM DONOR | LOAD ROLLER | DONOR STRIPPER BLADE |
|---|---|---|---|---|---|---|
| 24 | D | ----- | VAC. | VAC. | DISENG. | DISENG. |
| 24 | D | ----- | ATSMR. | ATSMR. | ↓ | ↓ |
| 25 | G | C.W. | ATSMR. | ATSMR. | | |
| 26 | G | ----- | VAC. | VAC. | | |
| 27 | G | C.W. | VAC. | VAC. | | |
| 28 | HOME | C.C.W. | ATSMR. | ATSMR. | | |

FIG. 14c

IMAGE PRODUCING PROCESS AND APPARATUS WITH MAGNETIC LOAD ROLLER

FIELD OF THE INVENTION

The invention relates to an image processing apparatus and a process for exposing an intended image on an imaging drum or the like, and, more particularly, to an image processing apparatus incorporating a magnetic load roller, and a process for loading media in an image processing apparatus.

BACKGROUND OF THE INVENTION

Pre-press color-proofing is a procedure that is used by the printing industry for creating representative images of printed material without the high cost and time that is required to actually produce printing plates and set up a high-speed, high volume, printing press to produce an example of an intended image. An image may require several corrections and be reproduced several times to satisfy or meet the customers requirements resulting in a large loss of profits and ultimately higher costs to the customer.

One such commercially available image processing apparatus is arranged to form an intended image on a sheet of thermal print media. Dye is transferred from a sheet of dye donor material to the thermal print media by applying a sufficient amount of thermal energy to the dye donor sheet material to form the intended image. This image processing apparatus generally includes a material supply assembly or carousel, and a lathe bed scanning subsystem or write engine, which includes a lathe bed scanning frame, translation drive, translation stage member, printhead, load roller, and imaging drum, and thermal print media and dye donor sheet material exit transports.

Operation of the image processing apparatus includes metering a length of the thermal print media (in roll form) from the material assembly or carousel. The thermal print media is then cut into sheet form of the required length and transported to the imaging drum. It is then registered, wrapped around, and secured onto the imaging drum. The load roller, which is also known as a squeegee roller, removes entrained air between the drum and the thermal print media. Next, a length of dye donor material (in roll form) is metered out of the material supply assembly or carousel, and cut into sheet form of the required length. It is then transported to the imaging drum and wrapped around it. A load roller is used to remove any air trapped between the imaging drum and the dye donor material. The dye donor material is superposed in the desired registration with respect to the thermal print media, which has already been secured to the imaging drum.

After the dye donor sheet material is secured to the periphery of the imaging drum, the scanning subsystem or write engine provides the scanning function. This is accomplished by retaining the thermal print media and the dye donor sheet material on the spinning imaging drum while it is rotated past the printhead to form an intended image on the thermal print media. The translation drive then traverses the printhead and translation stage member axially along the axis of the imaging drum in coordinated motion with the rotating imaging drum. These movements combine to produce the intended image on the thermal print media.

After the intended image has been formed on the thermal print media, the dye donor sheet material is removed from the imaging drum without disturbing the thermal print media beneath it. The dye donor sheet material is then transported out of the image processing apparatus. Additional dye donor sheet materials are sequentially superimposed with the thermal print media on the imaging drum, further producing an intended image. The completed image on the thermal print media is then unloaded from the imaging drum and transported to an external holding tray on the image processing apparatus.

Although the presently known and utilized image processing apparatus is satisfactory, a need exists to improve the load roller in regard to its interaction with the imaging drum, as well as mechanical adjustment and loading, and efficient removal of any air entrained beneath the print media.

SUMMARY OF THE INVENTION

Briefly summarized, according to one aspect of the present invention, the invention resides in an image processing apparatus comprising an imaging drum for holding a sheet of dye donor material and a sheet of thermal print media, and a magnetic load roller, which improves alignment, provides uniform loading to the imaging drum, and removes entrained air beneath the media. The image processing apparatus receives the thermal print media and the dye donor materials for processing an intended image onto the thermal print media. The magnetic load roller could in fact be utilized in any mechanical apparatus that requires a load roller.

According to a preferred embodiment of the present invention, an image processing apparatus for writing images to a thermal print media, comprises: a) a rotatable, magnet-attracting imaging drum mounted for rotation about an axis, the imaging drum being arranged to mount a receiver sheet and a donor sheet in superposed relationship thereon; b) a linear drive motor for rotating the imaging drum; c) a sheet transport assembly for transporting the thermal print media and donor sheets to the imaging drum; d) a printhead; e) a lead screw for moving the printhead in a first direction, the printhead being mounted on the lead screw; f) a linear translation subsystem on which the printhead, imaging drum, and lead screw are mounted; and g) a magnetic load roller.

Also included herein is an image producing process for loading thermal print media or donor material on an imaging drum, comprising the steps of:

a) rotating an imaging drum in a first direction of rotation;

b) actuating a sheet transport assembly and driving a sheet of thermal print media to the imaging drum until a leading edge of the thermal print media sheet engages the imaging drum, and then stopping the sheet transport assembly;

c) rotating the imaging drum in a second direction of rotation and stopping the imaging drum at a first media load position, d) moving a magnetic load roller into engagement with the leading edge of the thermal print media sheet;

e) rotating the imaging drum in a second direction of rotation until a trailing edge of the thermal print media sheet is under the magnetic load roller, and then stopping rotation of the imaging drum; and f) moving the magnetic load roller away from the imaging drum.

The present invention provides: a self-aligning, more reliable magnetic load roller that does not require a crown, and a magnet-attracting imaging drum. The magnetic load roller efficiently removes entrained air, therefore eliminating the need for a second pass with the load roller over the media. Also, the imaging drum preferably has at least one magnet embedded in its surface to aid in disengagement of the magnetic load roller from the imaging drum.

BRIEF DESCRIPTION OF THE DRAWINGS

A more complete understanding of the invention and its advantages will be apparent from the detailed description taken in conjunction with the accompanying drawings, wherein examples of the invention are shown, and wherein:

FIGS. 14*a–c* are charts showing imaging drum operating conditions at each of the steps shown in FIGS. 13*a–h*.

DETAILED DESCRIPTION OF THE INVENTION

Figure 1:
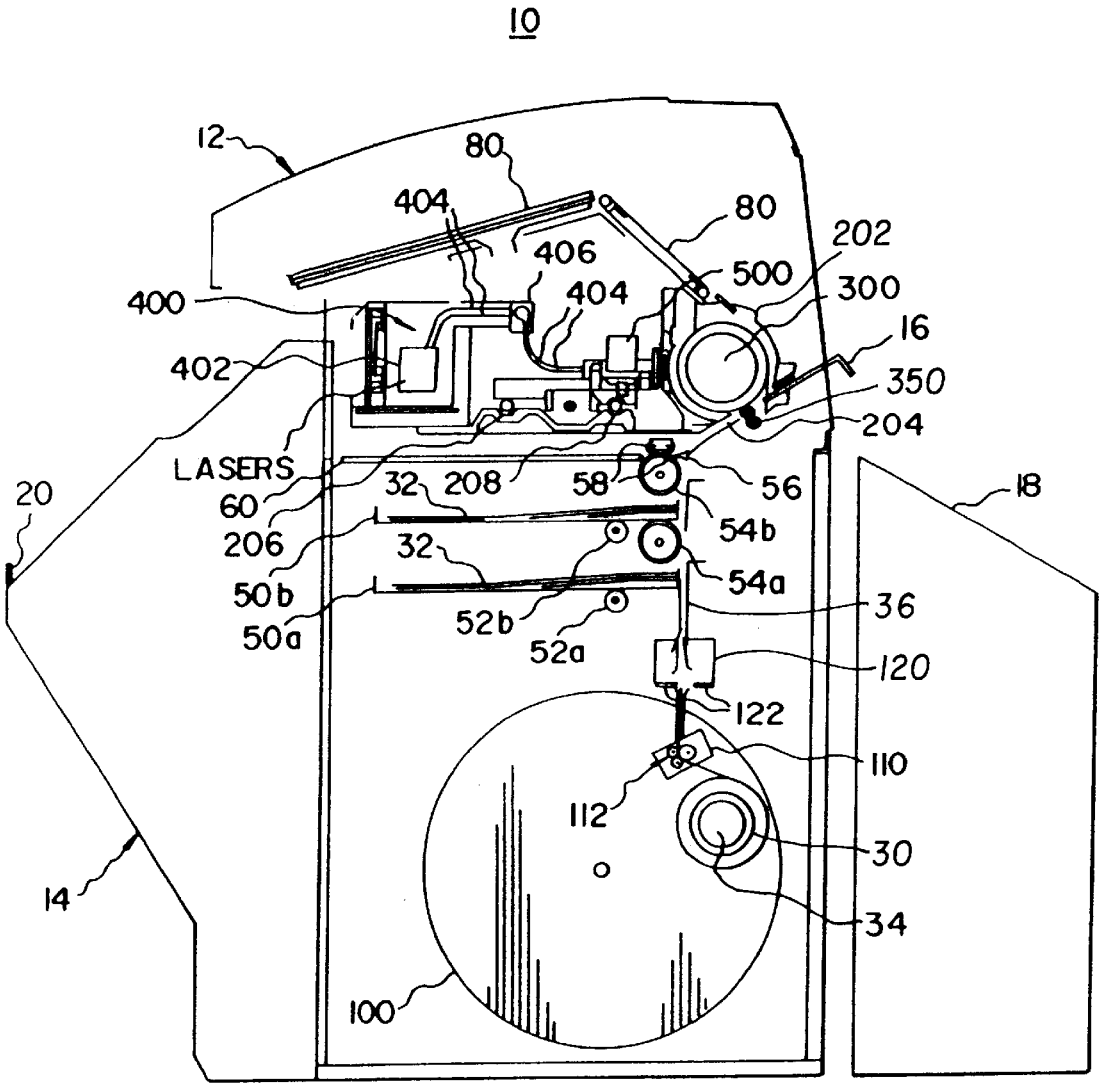
FIG. 1 is a side view in vertical cross-section of an image processing apparatus according to the present invention.

In the following description, like reference characters designate like or corresponding parts throughout the several views. Also, in the following description, it is to be understood that such terms as "front," "rear," "lower," "upper," and the like are words of convenience and are not to be construed as limiting terms. Referring in more detail to the drawings, the invention will now be described.

Turning first to FIG. 1, an image processing apparatus according to the present invention, which is generally referred to as 10, includes an image processor housing 12, which provides a protective cover for the apparatus. The apparatus 10 also includes a hinged image processor door 14, which is attached to the front portion of the image processor housing 12 and permits access to the two sheet material trays. A lower sheet thermal print material tray 50*a* and upper sheet input image material tray 50*b* are positioned in the interior portion of the image processor housing 12 for supporting thermal print media 32, or an input image, thereon. Only one of the sheet material trays 50 will dispense the thermal print media 32 out of the sheet material tray 50 to create an intended image thereon. The alternate sheet material tray either holds an alternative type of thermal print media 32, or an input image, or functions as a back up sheet material tray. In this regard, lower sheet material tray 50*a* includes a lower media lift cam 52*a*, which is used to lift the lower sheet material tray 50*a* and, ultimately, the thermal print media 32 upwardly toward lower media roller 54*a* and upper media roller 54*b*. When the media rollers 54*a, b* are both rotated, the thermal print media 32 is pulled upwardly towards a media guide 56. The upper sheet input image material tray 50*b* includes an upper media lift cam 52*b* for lifting the upper sheet thermal print material tray 50*b* and, ultimately, the thermal print media 32 towards the upper media roller 54*b*, which directs it toward the media guide 56.

Continuing with FIG. 1, the movable media guide 56 directs the thermal print media 32 under a pair of media guide rollers 58. This engages the thermal print media 32 for assisting the upper media roller 54*b* in directing it onto the media staging tray 60. The media guide 56 is attached and hinged to the lathe bed scanning frame 202 at one end, and is uninhibited at its other end for permitting multiple positioning of the media guide 56. The media guide 56 then rotates the uninhibited end downwardly, as illustrated. The direction of rotation of the upper media roller 54*b* is reversed for moving the thermal print medium receiver sheet material 32, which is resting on the media staging tray 60, under the pair of media guide rollers 58 upwardly through an entrance passageway 204 and up to the imaging drum 300.

A roll 30 of dye donor material 34 is connected to the media carousel 100 in a lower portion of the image processor housing 12, as shown in FIG. 1. Four rolls 30 are ordinarily used, but, for clarity, only one is shown in FIG. 1. Each roll 30 includes a dye donor material 34 of a different color, typically black, yellow, magenta and cyan. These dye donor materials 34 are ultimately cut into dye donor sheet materials 36 and passed to the imaging drum 300 for forming the medium from which dyes embedded therein are passed to the thermal print media 32 resting thereon. In this regard, a media drive mechanism 110 is attached to each roll 30 of dye donor material 34, and includes three media drive rollers 112 through which the dye donor material 34 of interest is metered upwardly into a media knife assembly 120. After the dye donor material 34 reaches a predetermined position, the media drive rollers 112 cease driving the dye donor material 34. Two media knife blades 122 positioned at the bottom portion of the media knife assembly 120 cut the dye donor material 34 into dye donor sheet materials 36. The lower media roller 54*a* and the upper media roller 54*b* along with the media guide 56 then pass the dye donor sheet material 36 onto the media staging tray 60 and ultimately to the imaging drum 300.

FIG. 1 shows an imaging drum 300 and a magnetic load roller 350. Once the thermal print medium receiver sheet material 32 is moved into position, the magnetic load roller 350 is moved into contact with the thermal print medium receiver sheet material 32 against the imaging drum 300. The imaging drum 300 has a ferrous coating that attracts the magnetic load roller 350 to it, with the magnetic load roller aligning itself to the imaging drum 300.

As shown in FIG. 1, a laser assembly 400 includes a quantity of laser diodes 402 in its interior. The lasers are connected via fiber optic cables 404 to a distribution block 406 and ultimately to a printhead 500. The printhead 500 directs thermal energy received from the laser diodes 402. This causes the dye donor sheet material 36 to pass the desired color across the gap to the thermal print media 32. The printhead 500 attaches to a lead screw 250 (see FIG. 2). A lead screw drive nut 254 and drive coupling (not shown) permit axial movement along the longitudinal axis of the imaging drum 300 for transferring the data to create the intended image onto the thermal print media 32.

For writing, the imaging drum 300 rotates at a constant velocity. The printhead 500 begins at one end of the thermal print media 32 and traverses the entire length of the thermal print media 32 for completing the transfer process for the particular dye donor sheet material 36 resting on the thermal print media 32. After the printhead 500 completes the transfer process for the particular dye donor sheet material 36 resting on the thermal print media 32, the dye donor sheet material 36 is removed from the imaging drum 300 and transferred out of the image processor housing 12 via a skive or ejection chute 16. The dye donor sheet material 36 eventually comes to rest in a waste bin 18 for removal by the user. The above-described process is then repeated for the other three rolls 30 of dye donor materials 34.

Continuing with FIG. 1, after the color from all four sheets of the dye donor sheet materials 36 has been transferred, the dye donor sheet material 36 is removed from the imaging drum 300. The thermal print media 32 with the intended image thereon is then removed from the imaging drum 300 and transported via a transport mechanism 80 out of the image processor housing 12 and comes to rest against a media stop 20.

Operation of the image processing apparatus 10 includes metering a length of the thermal print media (in roll form) from the material assembly or carousel. The thermal print media 32 is then measured and cut into sheet form of the required length and transported to the imaging drum 300. It is then registered, wrapped around, and secured onto the drum 300. Next, a length of dye donor material (in roll form) 34 is metered out of the material supply assembly or carousel, measured, and cut into sheet form of the required length. It is then transported to the imaging drum 300 and wrapped around the imaging drum using the load roller 350, so that it is superposed in the desired registration with respect to the thermal print media, which has already been secured to the imaging drum.

After the dye donor sheet material 36 is secured to the periphery of the imaging drum 300, the lathe bed scanning subsystem 200 or write engine provides the scanning function. This is accomplished by retaining the thermal print media 32 and the dye donor sheet material 36 on the spinning imaging drum 300 while it is rotated past the printhead 500 that will expose the thermal print media 32. The translator drive 258 then traverses the printhead 500 and translation stage member 220 axially along the axis of the imaging drum in coordinated motion with the rotating imaging drum 300. These movements combine to produce the intended image on the thermal print media 32.

Continuing with a description of the operation of the apparatus, the media carousel 100 is rotated about its axis into the desired position, so that the thermal print media 32 or dye donor material (in roll form) 34 can be withdrawn, measured, and cut into sheet form of the required length, and then transported to the imaging drum. To accomplish this, the media carousel 100 has a vertical circular plate, preferably with, though not limited to, six material support spindles. The support spindles are arranged to carry one roll of thermal print media, and four rolls of dye donor material. They provide the four primary colors, which are preferably used in the writing process to form the intended image. One roll is used as a spare or for a specialty color dye donor material, if so desired. Each spindle has a feeder assembly to withdraw the thermal print media or dye donor material from the spindles.

Figure 2:
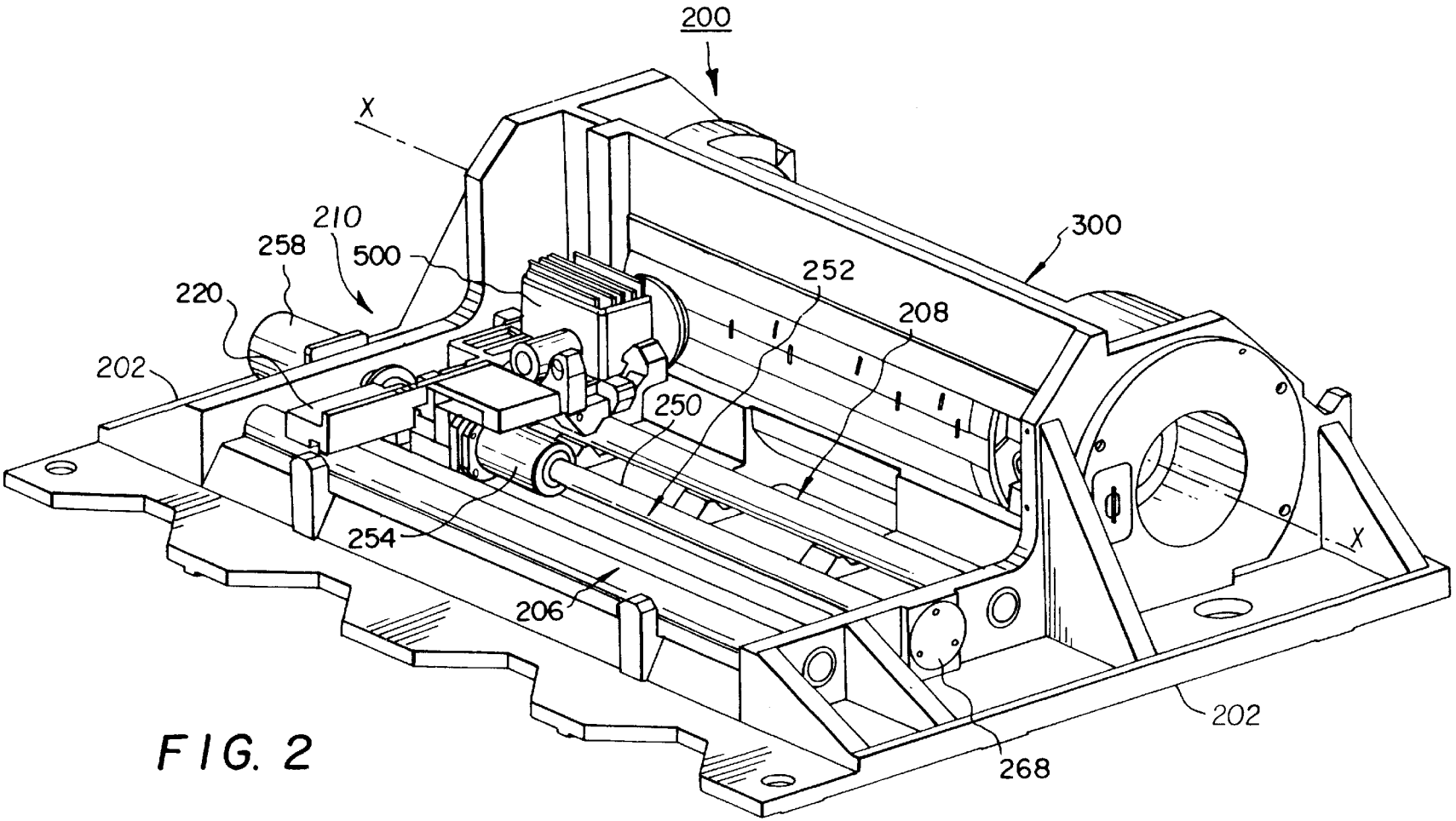
FIG. 2 is a perspective view of an image processing apparatus according to the present invention.

Turning to FIG. 2, the image processing apparatus 10 includes the imaging drum 300, printhead 500, and lead screw 250, which are assembled in the lathe bed scanning frame 202. The imaging drum 300 is mounted for rotation about an axis X in the lathe bed scanning frame 202. The printhead 500 is movable with respect to the imaging drum 300, and is arranged to direct a beam of light to the dye donor sheet material 36. The beam of light from the printhead 500 for each laser diode 402 (shown in FIG. 1) is modulated individually by modulated electronic signals from the image processing apparatus 10. These are representative of the shape and color of the original image. The color on the dye donor sheet material 36 is heated to cause volatilization only in those areas in which its presence is required on the thermal print media 32 to reconstruct the shape and color of the original image.

Continuing with FIG. 2, the printhead 500 is mounted on a movable translation stage member 220, which is supported for low friction movement on translation bearing rods 206, 208. The linear translation subsystem 210 includes the translation stage member 220, the translation bearing rods 206, 208, and the translator drive 258. The translation bearing rods 206, 208 are sufficiently rigid so as not sag or distort between mounting points and are arranged as parallel as possible with the axis X of the imaging drum 300, with the axis of the printhead 500 perpendicular to the axis X of the imaging drum 300 axis. The front translation bearing rod 208 locates the translation stage member 220 in the vertical and the horizontal directions with respect to axis X of the imaging drum 300. The rear translation bearing rod 206 locates the translation stage member 220 only with respect to rotation of the translation stage member 220 about the front translation bearing rod 208. This is done so that there is no over-constraint of the translation stage member 220, which might cause it to bind, chatter, or otherwise impart undesirable vibration or jitters to the printhead 500 during the generation of an intended image. The translator drive 258 traverses the translation stage member and printhead axially along the imaging drum.

Figure 3:
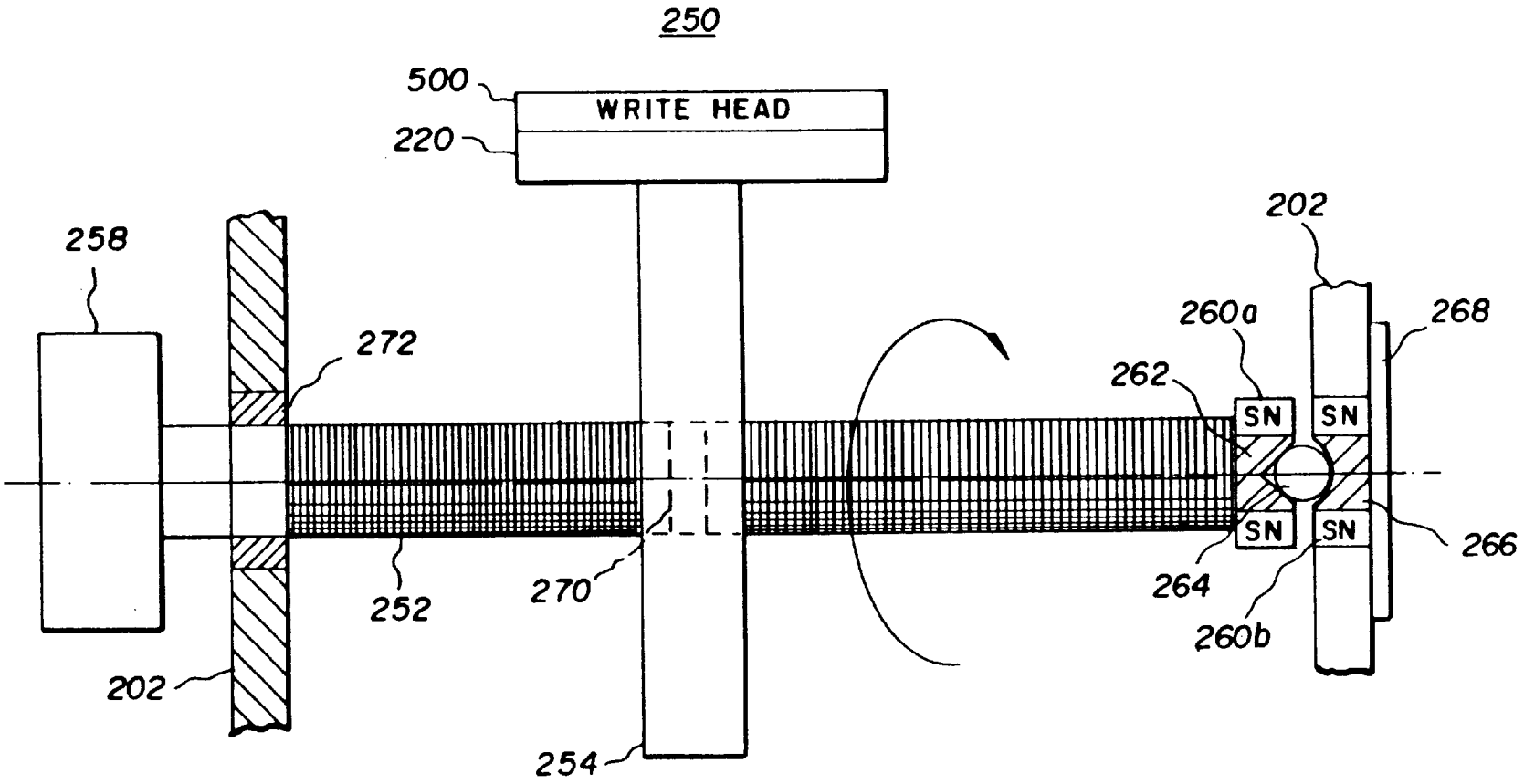
FIG. 3 is a top view in horizontal cross section, partially in phantom, of a lead screw according to the present invention.

Referring to FIGS. 2 and 3, the lead screw 250 includes an elongated, threaded shaft 252, which is attached to the translator linear drive motor 258 on its drive end and to the lathe bed scanning frame 202 by means of a radial bearing 272. A lead screw drive nut 254 includes grooves in its hollowed-out center portion 270 for mating with the threads of the threaded shaft 252. This allows the lead screw drive nut 254 axial movement along the threaded shaft 252 as the threaded shaft 252 is rotated by the linear drive motor 258. The lead screw drive nut 254 is integrally attached to the to the printhead 500 through the lead screw coupling (not shown) and the translation stage member 220 at its periphery, so that the threaded shaft 252 is rotated by the linear drive motor 258. This moves the lead screw drive nut 254 axially along the threaded shaft 252, which in turn moves the translation stage member 220, and ultimately the printhead 500 axially along the imaging drum 300.

As best illustrated in FIG. 3, an annular-shaped axial load magnet 260*a* is integrally attached to the driven end of the threaded shaft 252, and is in a spaced-apart relationship with another annular-shaped axial load magnet 260*b* attached to the lathe bed scanning frame 202. The axial load magnets 260*a* and 260*b* are preferably made of rare-earth materials such as neodymium-iron-boron. A generally circular-shaped boss 262 part of the threaded shaft 252 rests in the hollowed-out portion of the annular-shaped axial load magnet 260*a*, and includes a generally V-shaped surface at the end for receiving a ball bearing 264. A circular-shaped insert 266 is placed in the hollowed-out portion of the other annular-shaped axial load magnet 260*b*. It has an arcuate-shaped surface at one end for receiving ball bearing 264, and a flat surface at its other end for receiving an end cap 268 placed over the annular-shaped axial load magnet 260*b*, which is attached to the lathe bed-scanning frame 202 for protectively covering the annular-shaped axial load magnet 260*b*. This provides an axial stop for the lead screw 250.

Continuing with FIG. 3, the linear drive motor 258 is energized and imparts rotation to the lead screw 250, as indicated by the arrows. This causes the lead screw drive nut 254 to move axially along the threaded shaft 252. The annular-shaped axial load magnets 260*a*, 260*b* are magnetically attracted to each other, which prevents axial movement of the lead screw 250. The ball bearing 264, however, permits rotation of the lead screw 250 while maintaining the positional relationship of the annular-shaped axial load magnets 260, i.e., slightly spaced apart. Mechanical friction between them is thus prevented, yet the threaded shaft 252 can continue to rotate.

The printhead 500 travels in a path along the imaging drum 300, moving at a speed synchronous with the imaging drum 300 rotation and proportional to the width of the writing swath. The pattern transferred by the printhead 500 to the thermal print media 32 along the imaging drum 300 is a helix.

In operation, the scanning subsystem 200 or write engine contains the mechanisms that provide the mechanical actuations for the imaging drum positioning and motion control to facilitate placement of loading onto, and removal of the thermal print media 32 and the dye donor sheet material 36 from the imaging drum 300. The scanning subsystem 200 or write engine provides the scanning function by retaining the thermal print media 32 and dye donor sheet material 36 on the rotating imaging drum 300. This generates a once per revolution timing signal to the data path electronics as a clock signal, while the translator drive 258 traverses the translation stage member 220 and printhead 500 axially along the imaging drum 300 in a coordinated motion with the imaging drum rotating past the printhead. Positional accuracy is maintained in order to control the placement of each pixel, so that the intended image produced on the thermal print media is precise.

During operation, the lathe bed scanning frame 202 supports the imaging drum and its rotational drive. The translation stage member 220 and write head are supported by the two translation bearing rods 206, 208 that are positioned parallel to the imaging drum and lead screw. They are parallel to each other and form a plane therein, along with the imaging drum and lead screw. The translation bearing rods are, in turn, supported by the outside walls of the lathe bed scanning frame of the lathe bed scanning subsystem or write engine. The translation bearing rods are positioned and aligned therebetween.

The translation drive 258 is for permitting relative movement of the printhead 500 by means of a DC servomotor and encoder, which rotates the lead screw 250 parallel with the axis of the imaging drum 300. The printhead 500 is placed on the translation stage member 220 in the "V" shaped grooves. The "V" shaped grooves are in precise relationship to the bearings for the front translation stage member 220 supported by the front and rear translation bearing rods 206, 208. The translation bearing rods are positioned parallel to the imaging drum 300. The printhead is selectively locatable with respect to the translation stage member; thus it is positioned with respect to the imaging drum surface. The printhead has a means of adjusting the distance between the printhead and the imaging drum surface, and the angular position of the printhead about its axis using adjustment screws. An extension spring provides a load against these two adjustment means. The translation stage member 220 and printhead 500 are attached to the rotational lead screw 250, which has a threaded shaft, by a drive nut and coupling. The coupling is arranged to accommodate misalignment of the drive nut and lead screw so that only forces parallel to the linear lead screw and rotational forces are imparted to the translation stage member by the lead screw and drive nut. The lead screw rests between two sides of the lathe bed scanning frame 202, where it is supported by deep groove radial bearings. At the drive end, the lead screw 250 continues through the deep groove radial bearing through a pair of spring retainers. The spring retainers are separated and loaded by a compression spring, and to a DC servomotor and encoder. The DC servomotor induces rotation to the lead screw 250, which moves the translation stage member 220 and printhead 500 along the threaded shaft as the lead screw 250 is rotated. Lateral movement of the printhead 500 is controlled by switching the direction of rotation of the DC servomotor and thus the lead screw 250.

The printhead 500 includes a number of laser diodes 402, which are tied to the printhead and can be individually modulated to supply energy to selected areas of the thermal print media 32 in accordance with an information signal. The printhead 500 of the image processing apparatus 10 includes a plurality of optical fibers, which are coupled to the laser diodes 402 at one end and at the opposite end to a fiber optic array within the printhead. The printhead 500 is movable relative to the longitudinal axis of the imaging drum 300. The dye is transferred to the thermal print media 32 as radiation is transferred from the laser diodes by the optical fibers to the printhead, and thus to the dye donor sheet material 36, and is converted to thermal energy in the dye donor sheet material.

Figure 4:
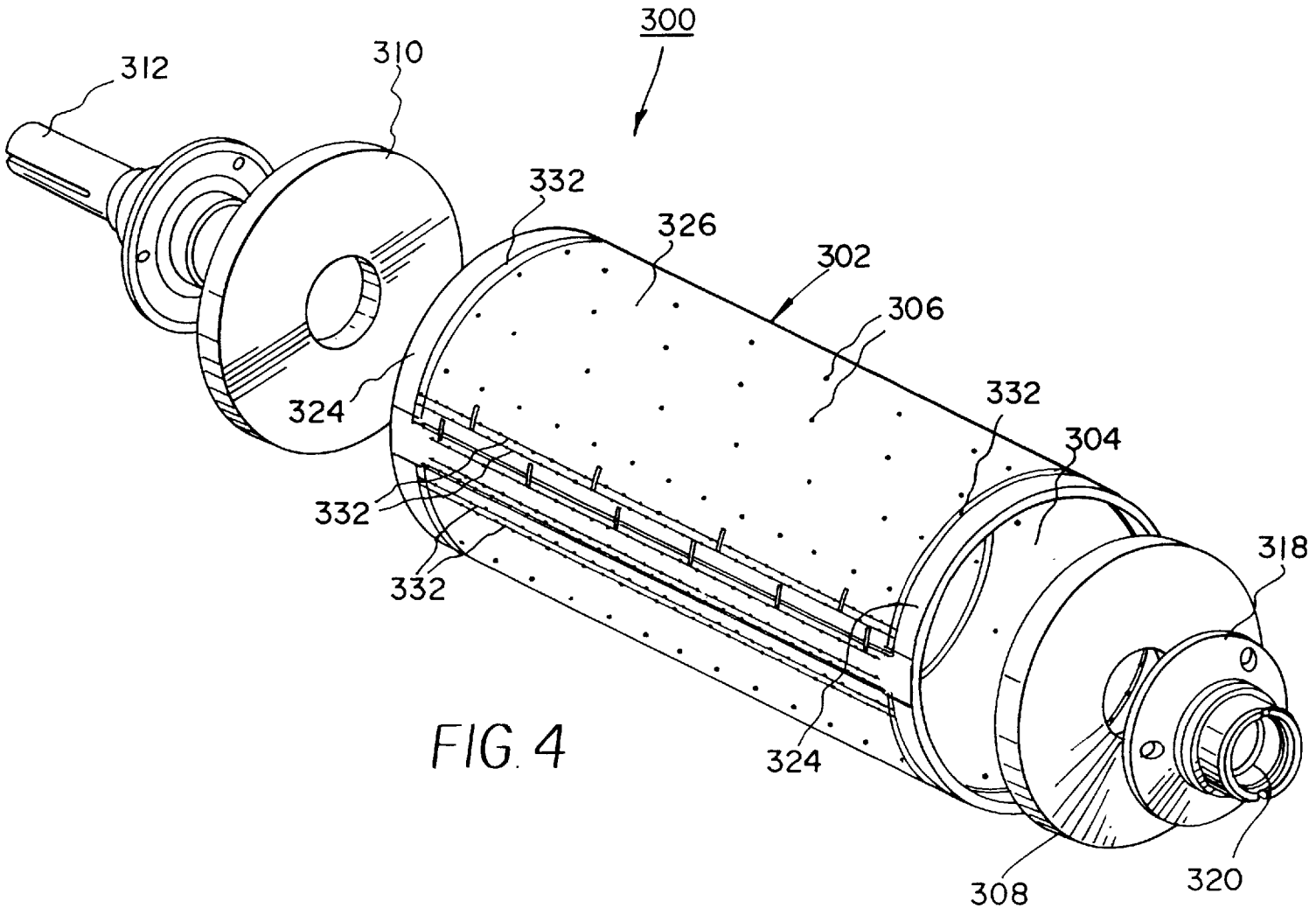
FIG. 4 is an exploded, perspective view of a vacuum imaging drum according to the present invention.

Referring to FIG. 4, the imaging drum 300 has a cylindrical-shaped vacuum drum housing 302. The imaging drum is, by definition, hollow, and includes a hollowed-out interior portion 304. The imaging drum 300 further includes a number of vacuum grooves 332 and vacuum holes 306 extending through the vacuum drum housing 302. Vacuum is applied from the hollow interior portion 304 of the imaging drum 300 through these vacuum grooves and holes. The vacuum supports and maintains the position of the thermal print media 32 and the dye donor sheet material 36, even as the imaging drum 300 rotates.

Continuing with FIG. 4, the ends of the imaging drum 300 are closed by a vacuum end plate 308, and a drive end plate 310. The drive end plate 310 is provided with a centrally disposed drive spindle 312, which extends outwardly therefrom through a support bearing. The vacuum end plate 308 is provided with a centrally disposed vacuum spindle 318, which extends outwardly therefrom through another support bearing.

The drive spindle 312 extends through the support bearing and is stepped down to receive a DC drive motor armature (not shown), which is held on by a drive nut. A DC motor stator (not shown) is stationarily held by the late bed scanning frame member 202 (see FIGS. 1 and 2), encircling the DC drive motor armature to form a reversible, variable DC drive motor for the imaging drum 300. A drum encoder mounted at the end of the drive spindle 312 provides timing signals to the image processing apparatus 10.

As shown in FIG. 4, the vacuum spindle 318 is provided with a central vacuum opening 320. The central vacuum opening 320 is in alignment with a vacuum fitting with an external flange that is rigidly mounted to the lathe bed scanning frame 202 (see FIGS. 1 and 2). The vacuum fitting has an extension, which extends within but is closely spaced from the vacuum spindle 318, thus forming a small clearance. With this configuration, a slight vacuum leak is provided between the outer diameter of the vacuum fitting and the inner diameter of the central vacuum opening 320 of the vacuum spindle 318. This assures that no contact exists between the vacuum fitting and the imaging drum 300 that might impart uneven movement or jitters to the imaging drum 300 during its rotation.

The opposite end of the vacuum fitting is connected to a high-volume vacuum blower (not shown), which is capable of producing 50–60 inches of water at an air flow volume of 60–70 CFM. The vacuum blower provides vacuum to the imaging drum 300. The vacuum blower provides the various internal vacuum levels required during loading, scanning and unloading of the thermal print media 32 and the dye donor sheet materials 36 to create the intended image. With no media loaded on the imaging drum 300, the internal vacuum level of the imaging drum 300 is preferably approximately 10–15 inches of water. With just the thermal print media 32 loaded on the imaging drum 300, the internal vacuum level of the imaging drum 300 is preferably approximately 20–25 inches of water. This level is desired so that when a dye donor sheet material 36 is removed, the thermal print media 32 does not move and color to color registration is maintained. With both the thermal print media 32 and dye donor sheet material 36 completely loaded on the imaging drum 300, the internal vacuum level of the imaging drum 300 is approximately 50–60 inches of water in this embodiment.

In operation, vacuum is applied through the vacuum holes 306 extending through the drum housing 302. The vacuum supports and maintains the position of the thermal print media 32 and dye donor sheet material 36 as the imaging drum 300 rotates. The ends of the imaging drum are preferably enclosed by the cylindrical end plates, which are each provided with a centrally disposed spindle 318. The spindles extend outwardly through support bearings and are supported by the scanning frame. The drive end spindle extends through the support bearing and is stepped down to receive the motor armature, which is held on by a nut. The stator is held by the scanning frame, which encircles the armature to form the reversible, variable speed DC drive motor for the imaging drum. An encoder mounted at the end of the spindle provides timing signals to the image processing apparatus. The central vacuum opening 320 on the opposite spindle 318 is in alignment with a vacuum fitting with an external flange that is rigidly mounted to the lathe bed scanning frame 202. The vacuum fitting has an extension extending within the vacuum spindle and forming a small clearance. A slight vacuum leak between the outer diameter of the vacuum fitting and the inner diameter of the opening of the vacuum spindle assures that no contact exists between the vacuum fitting and the imaging drum, which might impart uneven movement or jitters to the imaging drum during its rotation.

Figure 5:
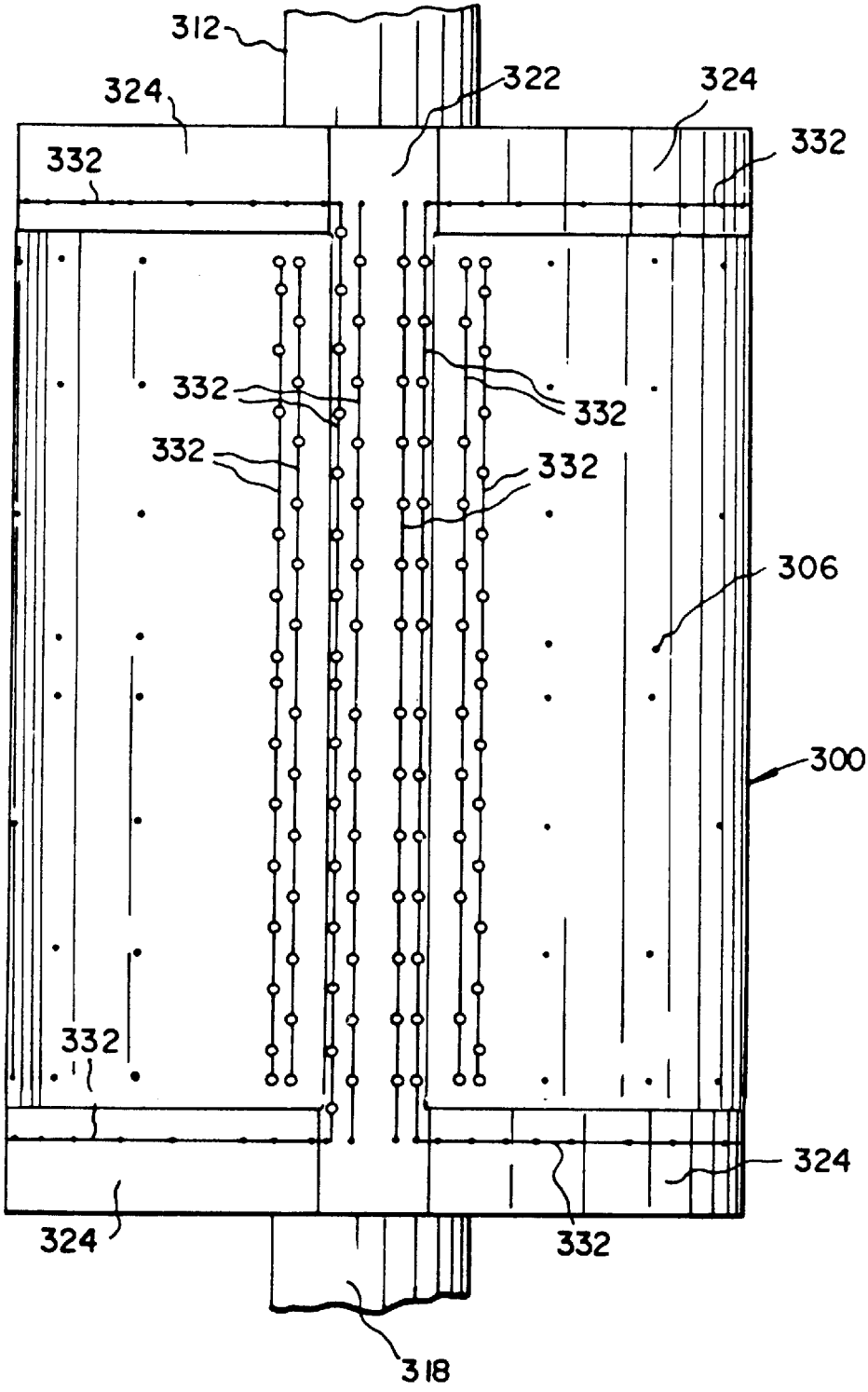
FIG. 5 is a plan view of a vacuum imaging drum surface according to the present invention.

Referring to FIG. 5, the outer surface of the imaging drum 300 is provided with an axially extending flat 322, which preferably extends approximately 8 degrees of the drum 300 circumference. The imaging drum 300 is provided with donor support rings 324, which form a radial recess 326 (see FIG. 4). This recess extends radially from one side of the axially extending flat 322 around the imaging drum 300 to the other side of the axially extending flat 322, from approximately one inch from one end of the imaging drum 300 to approximately one inch from the other end of the drum 300. Although a preferred embodiment herein does include an axially extending flat and a radial recess, the present invention need not include either.

The imaging drum axially extending flat has two main purposes. First, it assures that the leading and trailing ends of the dye donor sheet material are somewhat protected from the effect of air during the relatively high speed rotation that the imaging drum undergoes during the imaging process. Here, the air will have less tendency to lift the leading or trailing edges of the dye donor sheet material. The axially extending flat also ensures that the leading and trailing ends of the dye donor sheet material are recessed from the periphery of the imaging drum. This reduces the chance of the dye donor sheet material coming into contact with other parts of the image processing apparatus, such as the printhead. Such contact could cause a jam and possible loss of the intended image, or even catastrophic damage to the image processing apparatus.

The imaging drum axially extending flat also acts to impart a bending force to the ends of the dye donor sheet materials as they are held onto the imaging drum surface by vacuum from within the interior of the imaging drum. When the vacuum is turned off to that portion of the imaging drum, the end of the dye donor sheet material will tend to lift from the surface of the imaging drum. Thus turning off the vacuum eliminates the bending force on the dye donor sheet material, and is used as an advantage in the removal of the dye donor sheet material from the imaging drum.

Figure 6A:
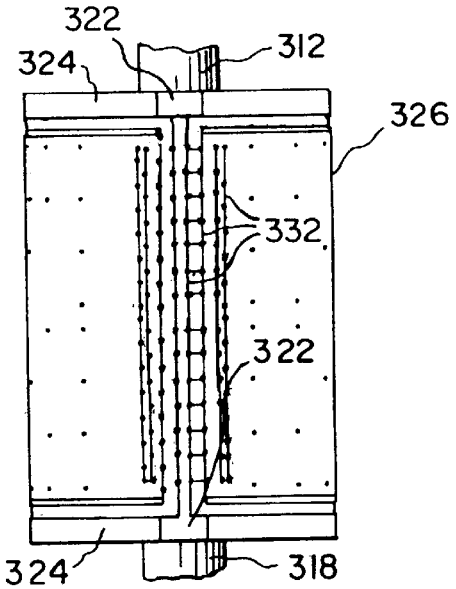
FIGS. 6A–6C are plan views of a vacuum imaging drum according to the present invention, showing a sequence of placement for thermal print media and dye donor sheet material.
Figure 6B:
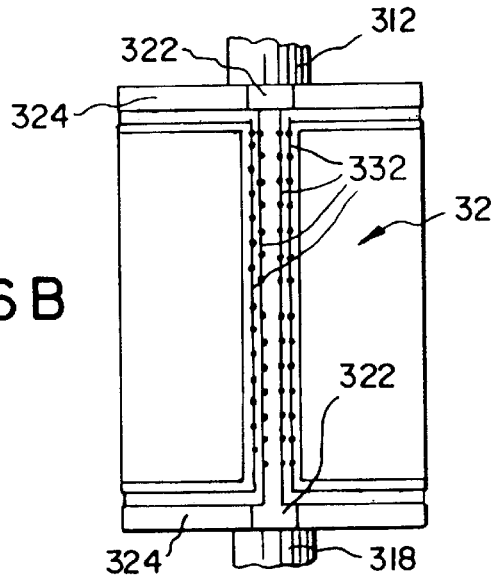
Figure 6C:
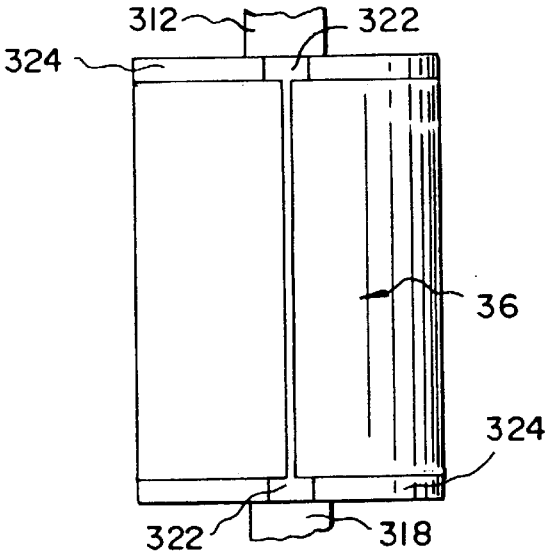

As shown in FIGS. 6A through 6C, the thermal print media 32 when mounted on the imaging drum 300 is seated within the radial recess 326. Therefore, the donor support rings 324 have a thickness which is substantially equal to the thickness of the thermal print media 32 seated therebetween. In this embodiment, this thickness is 0.004 inches. The purpose of the radial recess 326 on the imaging drum 300 surface is to eliminate any creases in the dye donor sheet material 36, as the materials are drawn down over the thermal print media 32 during the loading of the dye donor sheet material 36. This ensures that no folds or creases will be generated in the dye donor sheet material 36, which could extend into the image area and seriously adversely affect the intended image. The radial recess 326 also substantially eliminates the entrapment of air along the edge of the thermal print media 32, the vacuum holes 306 in the imaging drum 300 surface cannot always ensure the removal of the entrapped air. Any residual air between the thermal print media 32 and the dye donor sheet material 36 can also adversely affect the intended image.

Figure 7:
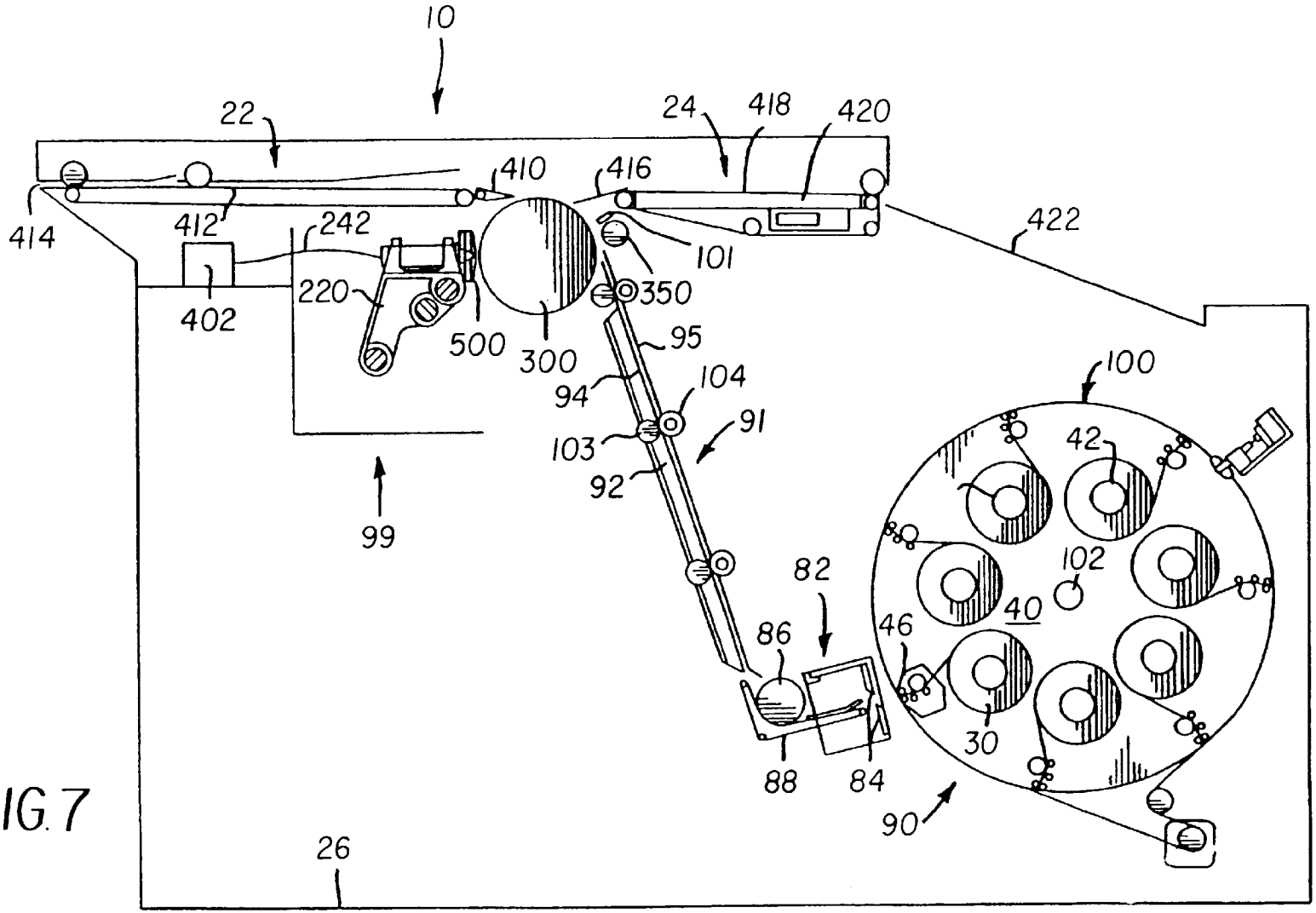
FIG. 7 is a schematic side elevational view of a proofing printer according to the present invention.

An alternate and also preferred embodiment of the present invention is illustrated in FIG. 7: a laser thermal printer proofer. The laser thermal printer proofer comprises generally a material supply assembly 90, a sheet cutter assembly 82, a sheet transport assembly 91, an imaging drum 300, a printhead assembly 99, and exit transport systems 22, 24, which are all described herein above or below.

Figure 8:
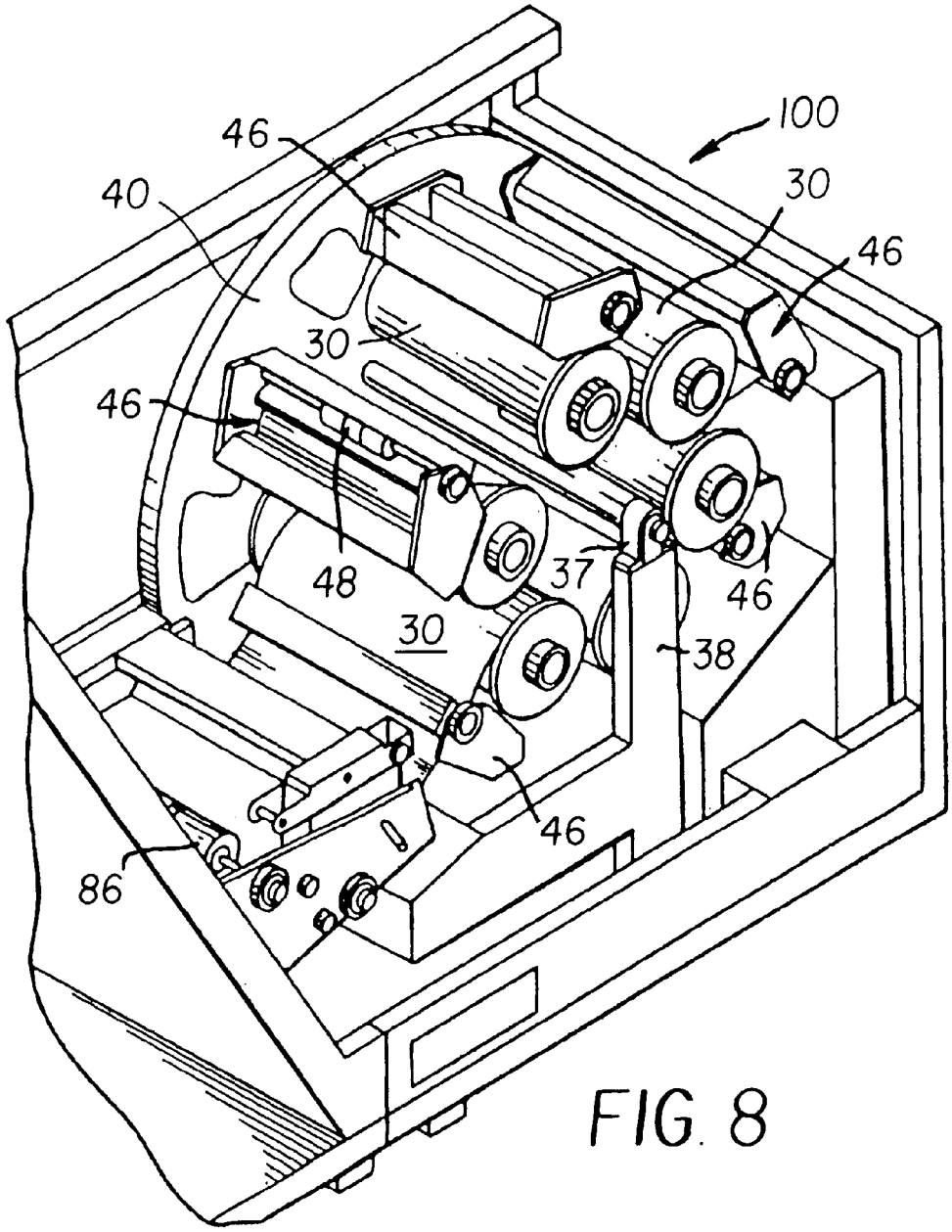
FIG. 8 is a front perspective view of a material supply carousel of a proofing printer according to the present invention.

Referring to FIGS. 7 and 8, the material supply assembly 90 comprises a carousel assembly 100 mounted for rotation about a horizontal axis 102 on bearings 37 at the upper ends of vertical supports 38. The carousel assembly comprises a vertical circular plate 40 having a plurality of material supporting spindles 42 cantilevered outwardly from and equispaced about the front fact of the circular plate. Each of the spindles 42 is arranged to carry a roll supply 30 of material for use on the imaging drum 300.

The carousel 100 is rotated counterclockwise in FIG. 7 by means of a drive motor 64 driving a sheave 66, which engages a belt 68 that is tensioned around the periphery of the carousel circular plate 40. A brake assembly 70 is arranged to hold the carousel stationary when it is not being driven by motor 64.

Continuing with FIG. 7, the sheet cutter assembly 82 is disposed adjacent the material supply carousel 100 at the material feed location and is arranged to receive the end of web material as it is fed by the material feed assembly 46. The sheet cutter assembly comprises a mating pair of cutter blades 84 through which the web material is moved by the material feed assembly 46. A material metering drum 86 and mating endless drive belt 88 cooperate to engage the web material as it is driven between the cutter blades 84, to assist the feeding thereof, and to change its path from substantially horizontal to a generally vertical direction. The metering drum 86 and a sensor are arranged to sense the end of the web material being fed and to determine when the desired length of the sheet has been fed between the cutter blades 84. At that point the metering drum 86 and the cooperating belt 88, as well as the drive assembly, are stopped and the cutter blades are actuated to chop a sheet member from the end of the web material. The web metering arrangement is capable of providing sheets having two different lengths for cutting the receiver material and the donor material. It is desired to form the donor material with a greater length than the receiver material, so that it overlies the leading and trailing ends of the receiver material when they are superposed upon the imaging drum. The material metering drum 86 and its mating drive belt 88 gently engage the material being transported, and do not scratch or otherwise damage the sensitive surface of the material being fed.

Although FIG. 8 illustrates a carousel having six spindles, a greater or lesser number of spindles may be provided depending upon the needs of the user. Each of the material supply spindles is provided with a corresponding material feeder assembly 46, only one of which is illustrated in FIG. 7. Each of the material feeder assemblies is arranged to withdraw the end of the roll material from the rolls 30 carried on the spindles 42.

The roll material 30 is provided to the apparatus 10 on flangeless cores to economize cost and weight. The flanges for the rolls 30 are part of the spindles 42 of the carousel. The weight of the roll of material is sufficient to keep the roll from telescoping, clockspringing, or unwinding unless the material is driven by the drive roller 48 (see FIG. 8).

The carousel 100 is rotated about its axis to bring a selected roll supply of material into opposition with the sheet cutter assembly 82 where the material is removed from the roll supply 30, is fed through the cutter assembly 82, is measured, and is then cut.

The sheet transport assembly 91 is also illustrated in FIG. 7. The sheet transport assembly 91 comprises an upwardly directed air table 94 open through into an air chamber 92 beneath. The air chamber 92 is provided with a source of pressurized air. The air escapes through a plurality of holes in the air table 94. A sheet is thus supported on the air table. The supply of air to the air chamber is controlled by a damper valve (not shown) in the inlet to the air chamber. A plurality of wire guides 95 are suspended above the surface of the air table 94 to limit the upward movement of the sheet due to air flow from the air table. One edge of the air table 94 is provided with an edge guide, which depends from a plate that lies in substantially the same plane as the wire guides 95. As shown in FIG. 7, three pairs of soft, flexible drive rollers 104 are disposed along the lateral edge of the air table 94. The drive rollers 104 form a nip with sheet transport rollers 103 and are arranged to gently engage the lateral edges of the sheets being transported to drive the sheet toward the imaging drum and urge it against the edge guide to provide lateral registration of the sheet with respect to the drum axis. The rollers 103, 104 are supplied with power from a motor.

The printhead, or writehead, assembly 99 comprises the printhead 500, translation stage member 220, and laser diodes 402, as shown in FIG. 7 and described above. The optical fibers extend from the end of the printhead assembly through a protective sheath 242 to the diode lasers 402 (see FIG. 7).

With regard to the exit transport systems of the present invention, the dye donor sheet material 36 is removed from the imaging drum without disturbing the thermal print media beneath it after the intended image has been written on the thermal print media 32. The exit transport systems comprise a waste sheet exit transport 22, and an image sheet exit transport 24. The dye donor sheet material 36 is transported out of the image processing apparatus 10, and additional dye donor sheet materials 36 are sequentially superimposed with the thermal print media 32 on the imaging drum. Then they are imaged onto the thermal print media until the intended image is complete. The completed image on the thermal print media is then unloaded from the imaging drum and transported to an external holding tray on the image processing apparatus by the receiver sheet material exit transport.

Referring to FIG. 7, the sheet material exit transport 22 includes a sheet material waste exit and an imaged sheet material exit. The dye donor sheet material exit transport includes a waste dye donor sheet material stripper blade 410, which is disposed adjacent to the upper surface of the imaging drum 300. The donor stripper blade 410 is movable between an unloading position, where it is in contact with the sheets on the imaging drum surface, and an inoperative position, where it is moved up and away from the surface of the imaging drum. In the unloading position, the donor stripper blade 410 contacts the waste dye donor sheet material on the imaging drum surface. When not in operation, the stripper blade is moved up and away from the surface of the imaging drum 300. A driven waste dye donor sheet material transport belt 412 is arranged substantially horizontally to carry the waste dye donor sheet material, which is removed by the stripper blade 410 from the surface of the imaging drum, to an exit 414 from the image processing apparatus. A waste bin 18 for waste/dye donor sheet materials is separate from the image processing apparatus 10 (see FIG. 1).

The image sheet exit transport 24 comprises a stationary image exit blade 416 disposed adjacent to the top surface of the imaging drum 300 substantially opposite from the movable stripper blade 410, as shown in FIG. 7. An image sheet transfer belt 418 is arranged for cooperation with a vacuum table 420 to deliver a receiver sheet with an image formed thereon to an exit tray 422 in the exterior of the apparatus.

As shown in FIG. 7, the material supply assembly 90, sheet cutter assembly 82, sheet transport assembly 91, imaging drum 300, load roller 350, printhead assembly 99, and exit transport systems 22, 24 are preferably enclosed by a proofing printer cabinet 26.

Figure 9:
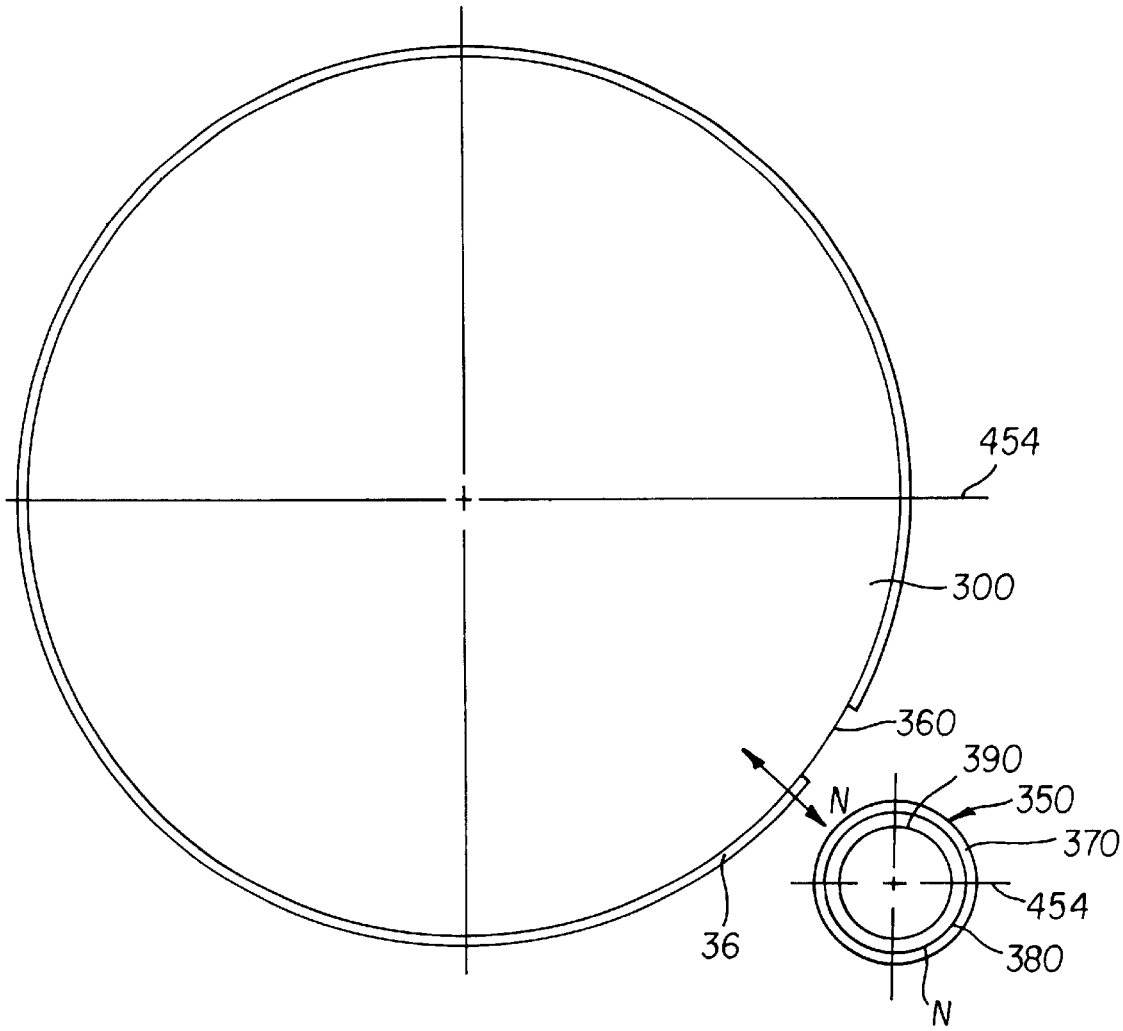
FIG. 9 is a partial schematic end view of an imaging drum and a magnetic load roller according to the present invention, shown in an unloaded position.
Figure 10:
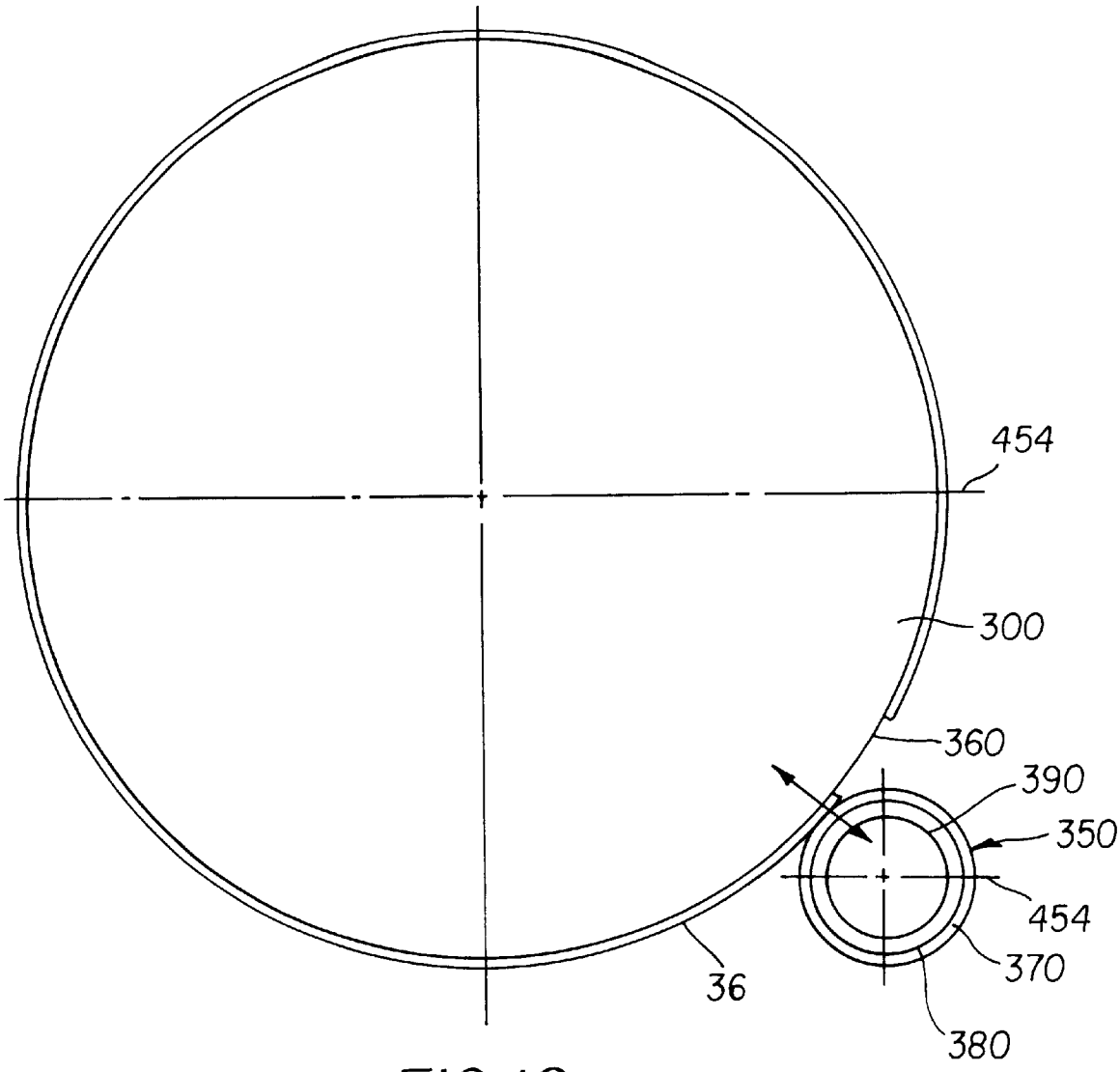
FIG. 10 is a partial schematic end view of an imaging drum and a magnetic load roller according to the present invention, shown in a loaded position.

An imaging drum 300 and a magnetic load roller 350 of the present invention are shown in partial schematic view in FIGS. 9 and 10. The magnetic load roller 350 is shown in an unloaded position in FIG. 9, with the load roller 350 detached from the surface of the imaging drum 300, and a loaded position in FIG. 10, with the magnetic load roller 350 articulated into the imaging drum. In the loaded position, the load roller 350 is in contact with the dye donor sheet material 36, which is in place over the thermal print media 32 on the imaging drum 300. When the apparatus 10 is in operation, the magnetic load roller 350 is in the loaded position. When the apparatus 10 is not in use, the load roller 350 is in the unloaded position.

In the preferred embodiment shown in FIGS. 9 and 10, the load roller 350 is comprised of three layers. The outermost layer is an elastic or elastomeric layer 370 or coating for cushioning the outside of the roller. The second layer is a magnetic layer 380. Beneath the magnetic layer is the load roller core 390, which is most preferably made of steel. The magnet layer is layered around the load roller core 390, and the elastomeric layer 370 is wrapped around the magnet layer 380. The imaging drum 300 is coated with a ferrous coating 360.

In operation, once the thermal print medium receiver sheet material 32 is in place, the dye donor sheet material 36 is positioned on the imaging drum 300 in registration with the thermal print media 32. The process for loading the thermal print media 32 to the imaging drum 300 is as described herein. The dye donor sheet material 36 now rests atop the thermal print media 32, with a narrow gap between the two. The narrow gap is created by micro-beads embedded in the surface of the thermal print media 32. The load roller 350 is moved into contact with the dye donor material 36. Surprisingly, when magnets are embedded in the surface of the load roller, or when the load roller is itself a magnet, the load roller aligns itself as it approaches the imaging drum. The imaging drum 300 has a ferrous coating 360 so that it attracts the magnetic load roller 350 when it is nearby. The imaging drum must be ferrous-coated or otherwise "magnet-attracting", so that it attracts the magnetic load roller when the load roller is in the vicinity of the imaging drum. The imaging drum 300 is then rotated counterclockwise, with the magnetic load roller 350 engaged, until the magnetic load roller 350 is at the end of the dye donor sheet material 36.

The direction of rotation of the imaging drum 300 is then reversed until the magnetic load roller 350 is passed to the opposite end of thermal print medium receiver sheet material 32, and over embedded magnets 395 in the imaging drum 300. The opposing force of the embedded magnets in the imaging drum forces the magnetic load roller 350 away from the surface of the imaging drum 300.

Figure 11:
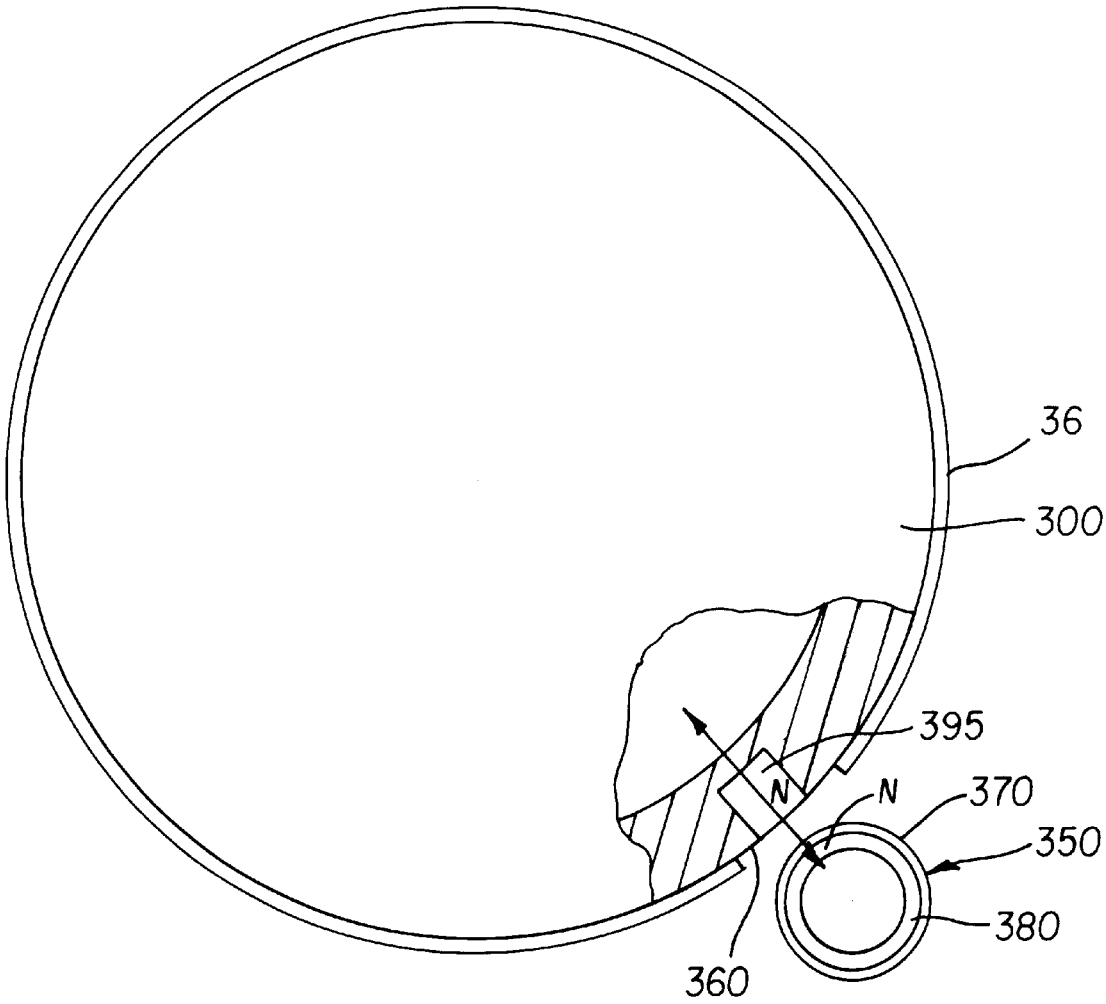
FIG. 11 is a cutaway partial schematic end view of an imaging drum and an external magnetic load roller according to the present invention, showing a magnet embedded in the imaging drum.

Referring to FIG. 11, a cutaway of the imaging drum 300 shows an unload drum magnet 395 embedded in the surface of the imaging drum. In this preferred embodiment, a thin line (e.g., about 1/16–1 inch wide) or row of at least one, and preferably a plurality of adjacent, unload drum magnets 395 extends the length of the imaging drum 300. The unload magnet 395 is charged with a North polarity. The external magnetic load roller 350 is shown in an unloading position. Once the imaging drum 300 rotates around so that the load roller 350 comes into contact with the line of magnets in the imaging drum, the North pole of the load roller 350 faces toward the North pole of the magnet 395 in the imaging drum 300. Since like forces repel, the opposing force between the magnetic fields of the imaging drum 300 and the load roller 350 force the magnetic load roller 350 away from the surface of the imaging drum 300.

This is in contrast to the loading position, where the magnetic North pole of the load roller 350 faces away from the North pole of the imaging drum 300, as shown in FIG. 9, and the load roller is attracted to the imaging drum.

Alternatively, brute force generated by the motor can be used to pull the load roller off the imaging drum once the task is complete.

There are several ways to prepare or manufacture the magnetic load roller. A ferromagnetic or stainless steel coating may be sprayed on the load roller. The load roller may be plasma coated or vacuum coated with a ferromagnetic coating. Individual or strip magnets may be cast into the load roller or epoxied onto the load roller. Magnets may be wrapped around the load roller. Alternatively, the load roller itself may be magnetized.

In a more difficult and therefore less preferred embodiment herein, the ferrous coating could be sprayed on the load roller 350, and the imaging drum 300 could be magnetized as described herein instead of the load roller. In the same manner as described herein, the load roller would thus be attracted to the imaging drum.

In the past, deflection caused a load roller to bow outward in the center over time in contact with the imaging drum. In an effort to remedy this, the ends of the load roller were crowned, so that the load roller was smaller in diameter at its ends than toward the inside of the roller. With the present invention, crowning is not necessary. This results in cost and time savings during manufacture of the load rollers. The present invention allows even distribution of pressure against the magnetic load roller. Magnets are preferably evenly distributed along the surface of the load roller, or the magnet layer is distributed evenly within the load roller, depending on the particular embodiment. The magnetic load roller 350 is evenly attracted along its length to the ferrous-coated imaging drum, except for the magnetic "unload" line 395 along the imaging drum. As described herein, the magnetic load roller 350 also provides uniform loading to the imaging drum.

Although a vacuum imaging drum is employed in this preferred embodiment, other types of imaging drums or similar surfaces may also be employed herein. The magnetic load roller of the present invention could in fact be utilized in any mechanical apparatus that requires a load roller to remove entrained air between the media and the operating surface, such as a lamination roller. For example, a magnetic load roller 350 may be used in an imaging apparatus having an ink jet head rather than a laser printer to remove entrained air between a receiver sheet and the surface on which the image is formed.

Also, a magnetic load roller according to the present invention can be used with a platen instead of an imaging drum, so long as the platen is coated with or contains a material, which is attractive to the magnetic field of the load roller 350. The platen can be, for example, coated with a ferrous coating, or it can be made of plastic or rubber that is manufactured or coated with a ferrous material.

Figure 12:
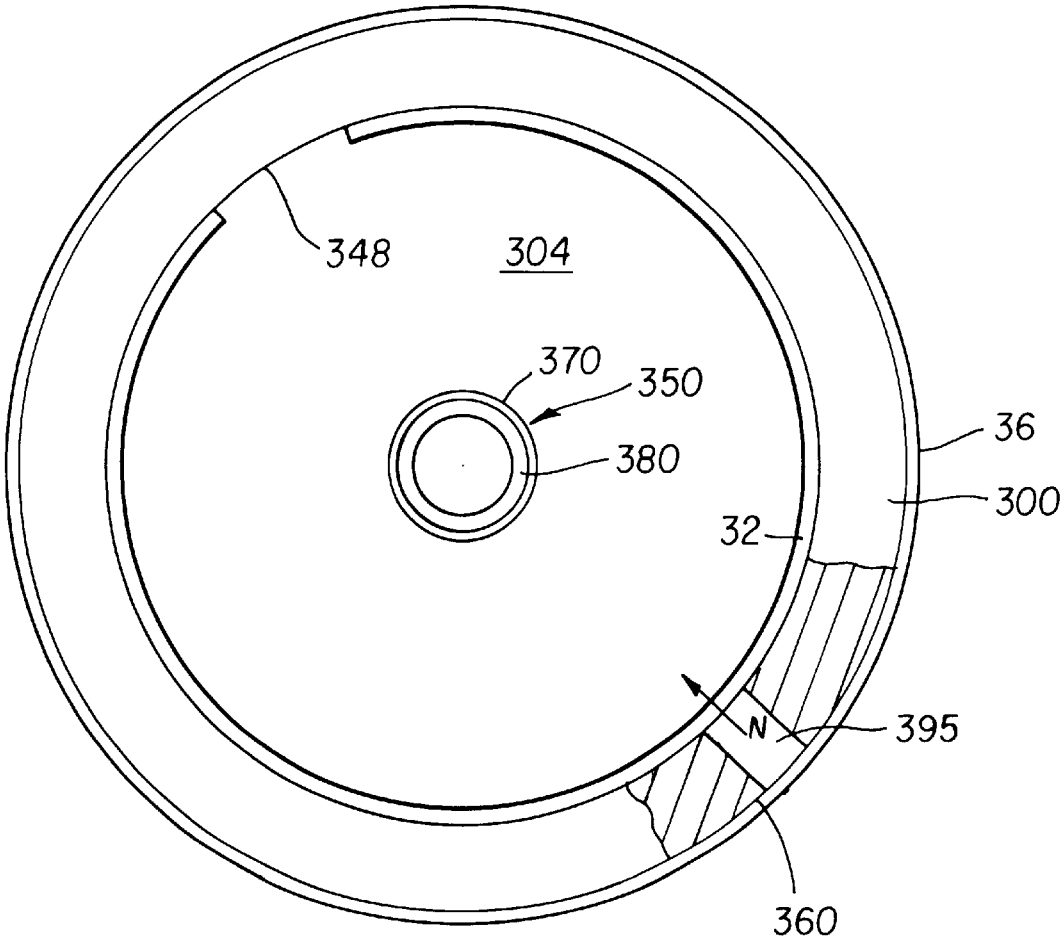
FIG. 12 is a schematic end view of an imaging drum and an internal magnetic load roller according to the present invention, showing a magnet embedded in the imaging drum.

Referring to FIG. 12, another alternative embodiment herein is a magnetic load roller 350 positioned on the inside of a hollow imaging drum 300 rather than outside the drum. Such a magnetic load roller 350 may be used, for example, with an internal drum scanner or an internal drum writer to eliminate entrained air. In this embodiment, the magnetic load roller 350 is articulated away from the surface of the imaging drum 300, as shown in FIG. 12, when it is not in use. When in use, the magnetic load roller 350 is attracted to the ferrous coating of the inside drum wall 348. Once the thermal print media 32, or other suitable type of media, is loaded on the inside drum wall 348, the magnetic load roller 350 presses against the thermal print media sheet 32 on the inside wall 348 of the imaging drum 300. As the imaging drum 300 rotates in either direction, any entrained air between the thermal print media sheet 32 and the inside drum wall 348 is eliminated by the action of the magnetic load roller 350. Once the magnetic load roller 350 comes into contact with the row of magnets 395 embedded in the surface of the inside drum wall 348, it disengages from the inside drum wall 348.

In general, a preferred imaging apparatus for forming images on a print media, comprises: a) an imaging head, most preferably a printhead 500; b) a magnet-attracting imaging surface; c) print media, most preferably a thermal print media sheet 32, removably mounted on the imaging surface, the imaging head being positioned to move over the print media on the imaging surface; and d) a magnetic load roller 350. Preferably, the imaging apparatus is an ink jet printer or, most preferably, a laser printer. The imaging surface is preferably a platen comprising a ferrous material, or an imaging drum internally or externally coated with a ferrous material so that it attracts (hence the term "magnet-attracting") the magnetic load roller when it is nearby. The load roller preferably comprises a plurality of magnets embedded in its surface, which provide its magnetic field.

An alternate, less preferred embodiment herein comprises: (a) a magnetic, rotatable imaging drum; (b) an imaging head which is movable along the longitudinal axis of the imaging drum at a speed synchronous with the rotation of the imaging drum; (c) thermal print media removably mounted on the imaging drum, the imaging head being positioned to systematically travel over the thermal print media on the imaging drum; and (d) a load roller coated with a ferrous material.

The operational sequence of one embodiment, a laser thermal printer proofer, according to the present invention will now be described with reference to FIGS. 7, 10, 11, 13*a–h*, 14*a–c*, and 15. This preferred embodiment includes a drum flat and a sheet sensor. Other embodiments herein, which are also preferred, though, do not have a drum flat or sheet sensor and employ other devices for, or means of, positioning the media.

Figure 15:
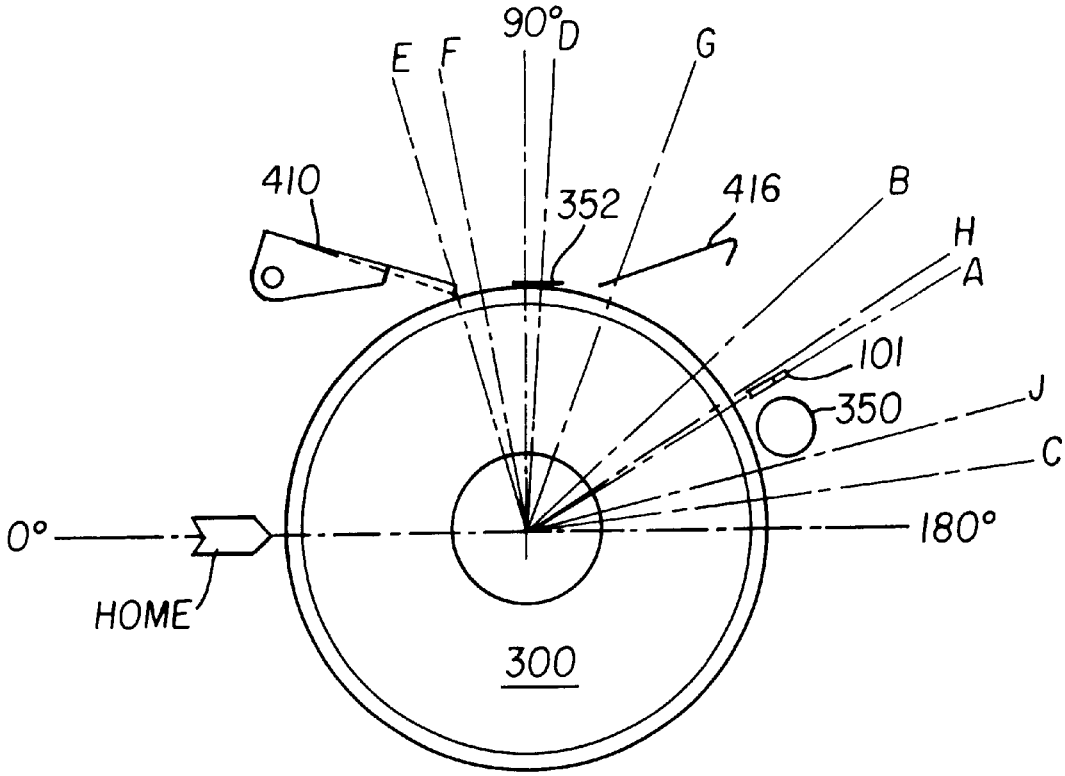
FIG. 15 is a schematic end view of an imaging drum and magnetic load roller according to the present invention showing the various operating positions.

In the following description of the operation, the sequence step order is indicated at the beginning of each step as a number in a bracket [#], which also corresponds to the sequence number indicated in the chart illustrated in FIGS. 14*a–c*. FIGS. 13*a–h* show the loading and unloading of material to and from the imaging drum 300 at various selected steps in the process. FIGS. 14*a–c* show tabulations of drum operating conditions at each of the steps shown in FIGS. 13*a–h*. FIG. 15 illustrates an imaging drum 300 and magnetic load roller 350 in various operating positions. The drum centerline positions noted in FIG. 15 are illustrated schematically in FIGS. 13*a–h*.

Figure 13A:
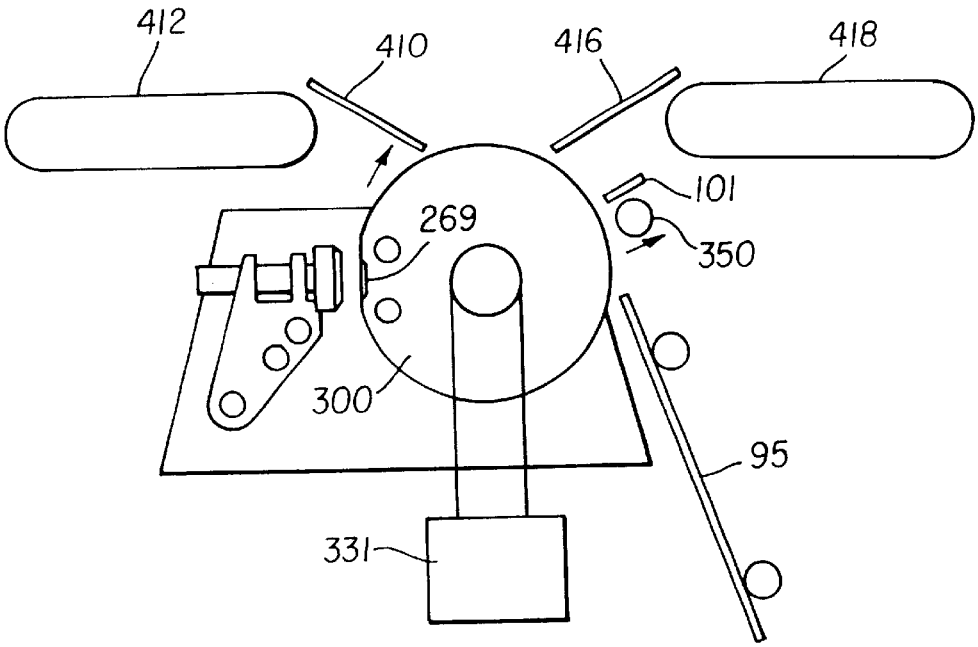
FIGS. 13*a–h* are partial schematic illustrations of a material supply handling system according to the present invention, showing the loading and unloading of material.

[1] With the imaging drum 300 located with the centerline 269 of the drum flat 352 located in the "Home" position, as shown in FIG. 15, the carousel 100, imaging drum 300, metering roll 86, and the sheet drive rollers 103, 104 are all stationary. At "Home", no material is superposed on the imaging drum 300 and the vacuum pump connected thereto is off. The magnetic load roller 350 is disengaged from the imaging drum 300, as is the donor stripper blade 410. To begin, the carousel 100 is rotated until the supply roll 30 of the receiver material 32 is located adjacent to the sheet cutter assembly 82. The carousel is stopped and the edge guide is disposed in a first, receiver, position. The air to the air table 94 is turned off by closing the damper valve. The sheet feed roll 48 is driven by the drive, feeding the end of the receiver web into the sheet cutter assembly 82. There it is engaged by the metering roll 86 and drive belt 88 and advanced until the proper length of material is determined. The cutter blades 84 are actuated. The condition of the overall system at this point is illustrated in FIG. 13*a*.

[2] The imaging drum is then rotated in a first, clockwise direction. Where the drum has a drum flat, the imaging drum 300 is stopped with the centerline 269 of the drum flat 352 disposed under the sheet sensor 101 at position H (see FIGS. 14 and 15). All other conditions are the same as Step 1.

[3] The sheet transport assembly 91 is then actuated and the thermal print media sheet 32 is driven up until its leading edge is sensed by the sheet sensor 101 and the transport assembly drive rollers and the sheet are stopped. As the thermal print media sheet 32 is driven into engagement with the imaging drum 300, the sheet sensor 101 detects the lead edge of the sheet 32 by detecting the reflection from the surface of the sheet and the sheet 32 is stopped with its edge at the sheet sensor 101 centerline at position "A" (see FIG. 15).

[4] The imaging drum is then rotated counterclockwise to the thermal print media load position "B" (see FIG. 15) and is stopped.

[5] Where the imaging drum is a vacuum drum, the vacuum to the imaging drum 300 is then actuated by actuating the vacuum pump. All of the vacuum openings and vacuum chambers in the imaging drum are supplied with vacuum at this point. A vacuum blower 331, which supplies vacuum to the vacuum drum, is shown in FIGS. 13*a–h*.

Figure 13B:
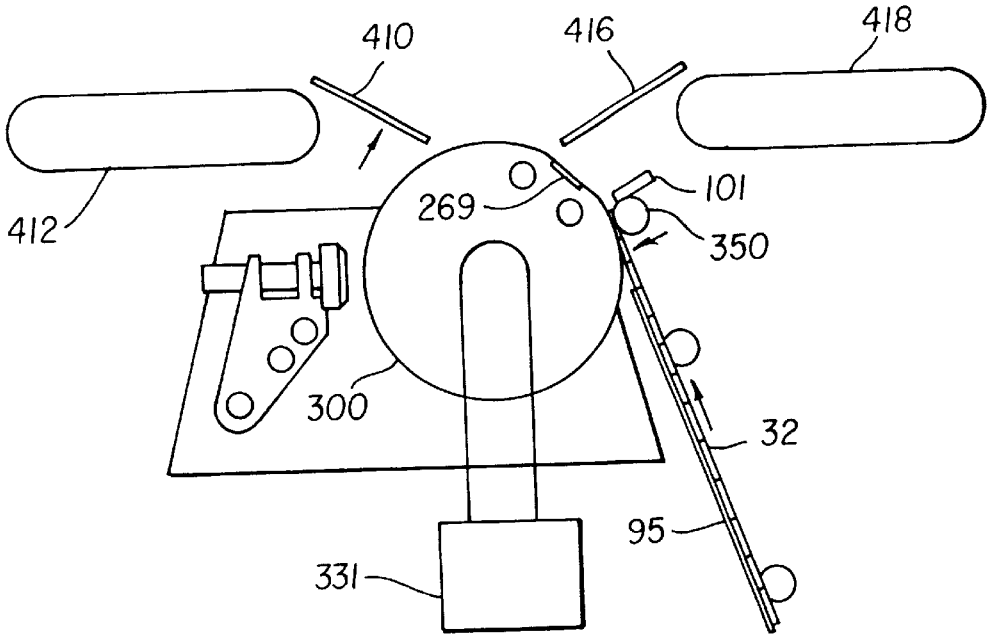

[6] The magnetic load roller 350 is moved into engagement with the end of the thermal print media sheet 32. The vacuum operates to hold the thermal print media sheet 32 to the drum surface. The condition of the overall system at this point is illustrated in FIG. 13*b*. Since the load roller 350 is magnetic, it is attracted to the ferrous-coating 360 of the imaging drum 300 (see FIG. 11). It is therefore not necessary to mechanically press the magnetic load roller 350 against the imaging drum 300.

[7] The imaging drum 300 is then rotated counterclockwise until the trailing edge of the thermal print media sheet 32 is under the magnetic load roller 350. The magnetic load roller 350 facilitates the removal of the air from between the thermal print media sheet 32 and the drum surface. Since the magnetic load roller 350 is so effective, it is not necessary to rotate the imaging drum clockwise again until the lead edge of the thermal print media sheet 32 is beneath the load roller 350. The magnetic load roller therefore saves a step in the imaging process.

[8] The magnetic load roller 350 is then moved away from the imaging drum 300. Preferably, the imaging drum 300 is then rotated counterclockwise until the line of magnets 395 on the imaging drum 300 nears the magnetic load roller 350. The force of the repulsion moves the load roller to a disengaged, or unload, position, which is spaced apart from the surface of the imaging drum. Alternatively, the magnetic load roller 350 is mechanically pulled away from the imaging drum 300.

[9] The carousel 100 is rotated and stopped at the appropriate donor supply location, and the edge guide is moved to the second, donor position so the dye donor sheet will properly overlap the thermal print media sheet 32 when the dye donor sheet 36 is superposed therewith on the imaging drum 300. The sheet feed roll 48 is driven by the drive, feeding the end of the donor web into the sheet cutter assembly where it is engaged by the metering roll 86 and belt 88 and advanced until the proper length is reached. The cutter blades 84 are actuated to cut off a dye donor sheet. The imaging drum is rotated clockwise to the donor sheet loading position "H".

[10] The vacuum to a donor chamber is turned off by engaging a valve actuator cam actuated by a motor. The chamber is opened to atmospheric pressure because, since the thermal print media sheet has previously been superposed on the majority of the imaging drum surface, closing off the majority of the vacuum openings therethrough, the vacuum now available at the lead edge of the donor sheet is sufficiently strong that it might prevent the movement of the sheet over the drum surface were that portion of the vacuum holes not isolated from the vacuum.

Figure 13C:
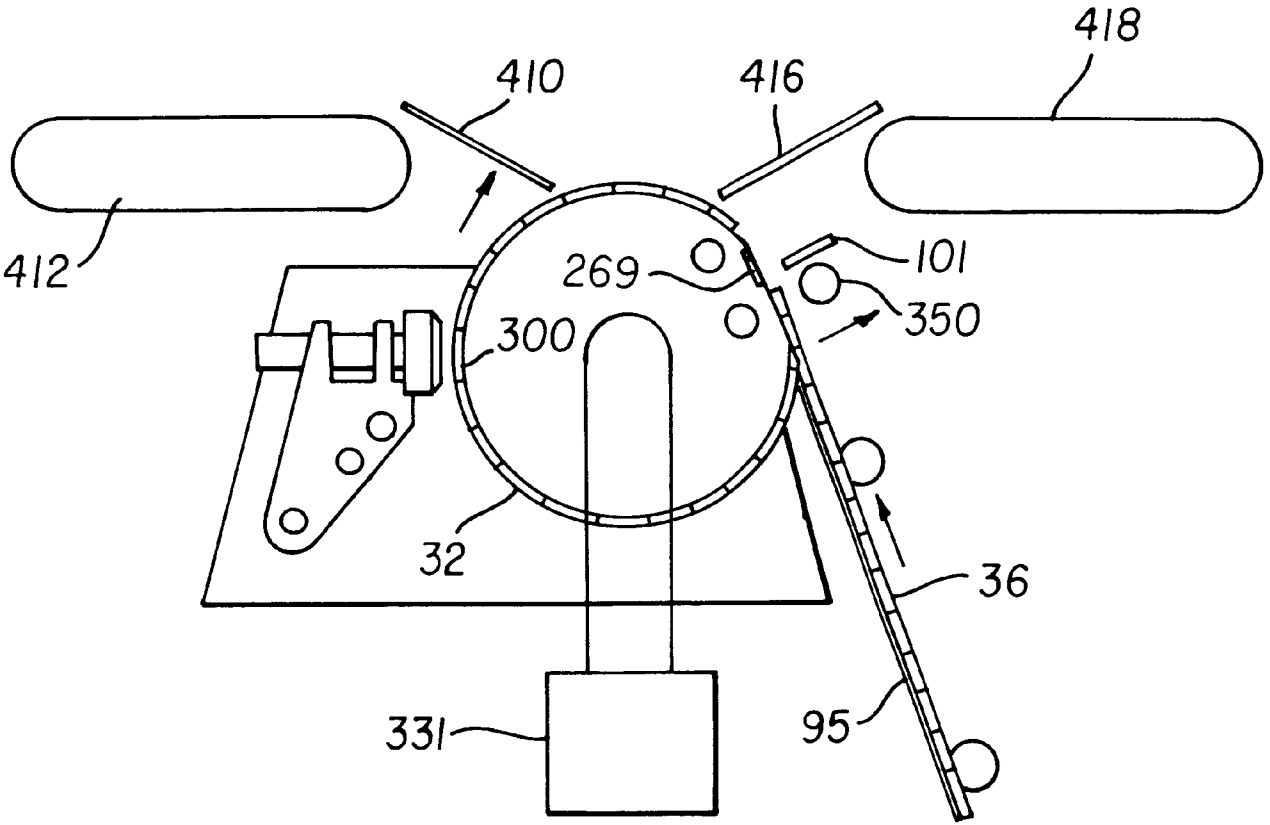

[11] The dye donor sheet 36, which is now located on the sheet transport assembly 91, is driven upward and stopped with the leading edge of the dye donor sheet at the sheet sensor 101. The sheet sensor 101 has previously checked the location of the thermal print media sheet 32 to assure that it does not overlie a registration indicia and, if it does, to generate a fault signal to stop the sequence. The condition of the overall system at this point is illustrated in FIG. 13*c*.

[12] The vacuum to the donor chamber is turned back on by disengaging the valve actuator cam. Vacuum is thus reapplied to the leading edge of the dye donor sheet 36.

[13] The magnetic load roller 350 is then moved to the engaged position (see FIG. 10), which forces the dye donor sheet 36 into engagement with the drum flat 352.

Figure 13D:
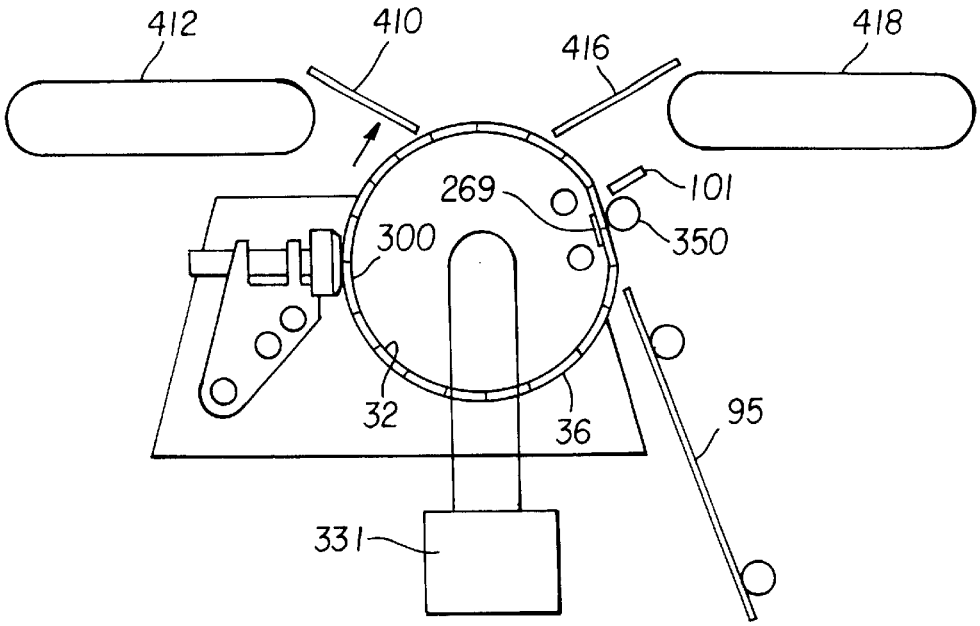

[14] The imaging drum 300 is rotated counterclockwise until the trailing edge of the donor sheet 36 is under the magnetic load roller 350. The condition of the overall system at this point is illustrated in FIG. 13*d*.

Importantly, reversing the imaging drum 300 and re-rolling the dye donor sheet 36 into contact with the thermal print media sheet 32 was necessary prior to the present invention because some air often still remained after the first pass of the load roller. Such residual entrained air went unnoticed until the image was formed. Areas of low density arc were caused by the entrained air. A second pass of the load roller was necessary to eliminate the remaining entrained air. With the present invention, the attraction between the imaging drum and the magnetic load roller 350 applies greater pressure on the media during the first pass. Since residual entrained air is eliminated during the first pass, a second pass is not necessary. This saves time and reduces complication. Thus, a method of rolling out sheet material so as to remove air entrapment between the sheet media and the drum or platen, or between sheets of media, is provided herein.

[15] The imaging drum 300 is rotated in an opposite direction, until the row of magnets 395 in the imaging drum 300 disengages the magnetic load roller 350 from the imaging drum (see FIG. 11), or until the magnetic load roller is mechanically disengaged. The rotation of the imaging drum 300 is then accelerated in the counterclockwise direction to image writing speed, and the imaging process commences.

After the image has been written onto the thermal print media sheet from the first donor sheet, the first donor sheet must be removed from super-position with the thermal print media sheet without moving the thermal print media from its location on the imaging drum surface. The donor sheet must be removed without disturbing the thermal print media sheet. This is accomplished by the following sequence of steps:

[16] The imaging drum is stopped at the donor unload position indicated by position "F" in FIG. 15.

[17] The donor stripper blade 410 is actuated to the position against the imaging drum surface.

Figure 13E:
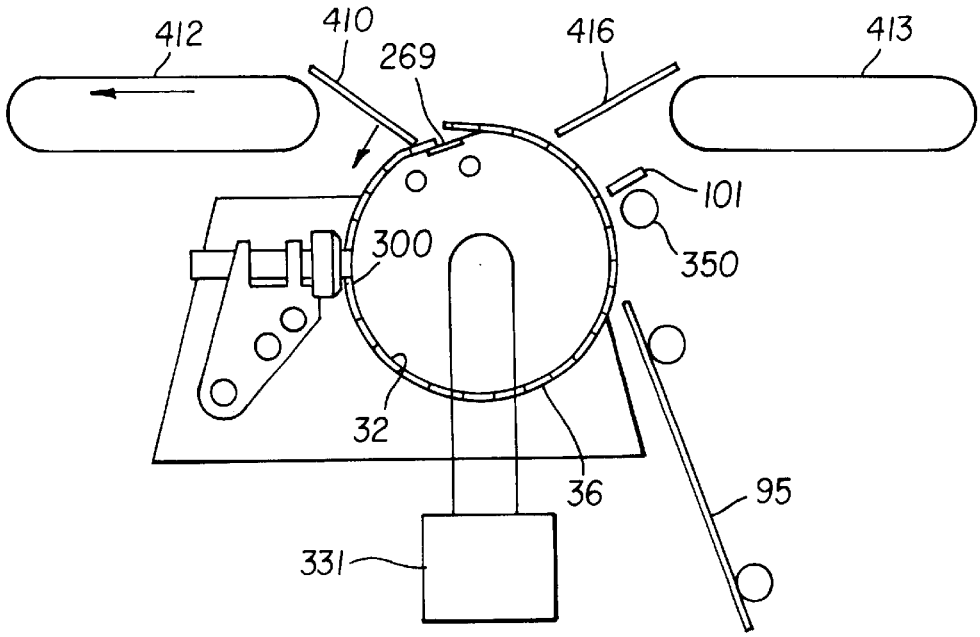

[18] The vacuum chamber valve actuator cam 398 is actuated to engage the valve actuators to both the donor vacuum chamber 362 and the receiver vacuum chamber 364. At this point, since the vacuum under the leading edge of the donor sheet has been turned off, and since this portion of the donor sheet has been wrapped around the leading edge of the drum flat, the beam strength of the sheet material tends to lift the leading edge of the donor sheet from the drum flat 352, as illustrated in FIG. 13*e*. Although the vacuum to the trailing edge of the thermal print media sheet has also been turned off, the trailing edge of the 29 thermal print media sheet is still held by the superposed trailing edge of the donor sheet.

Figure 13F:
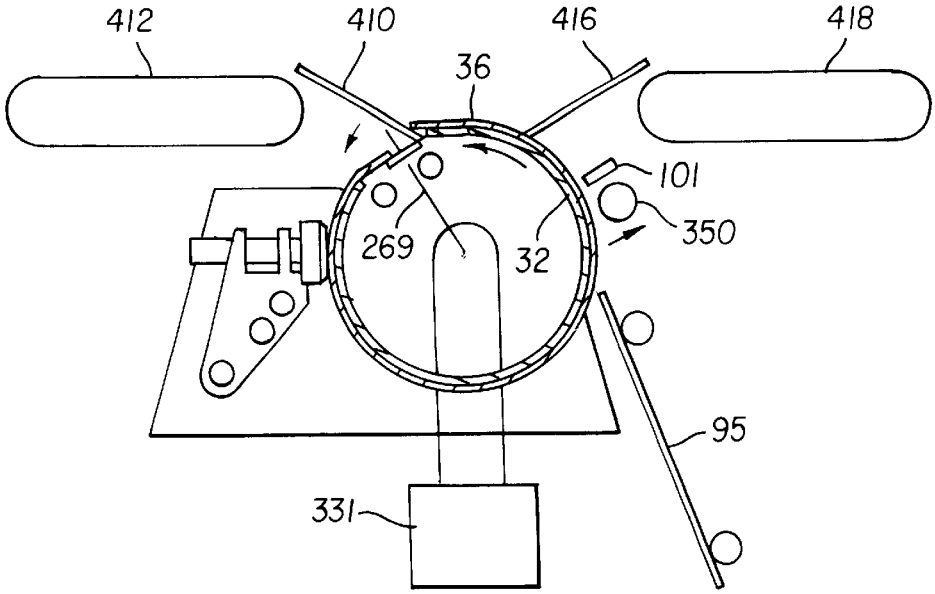
Figure 13G:
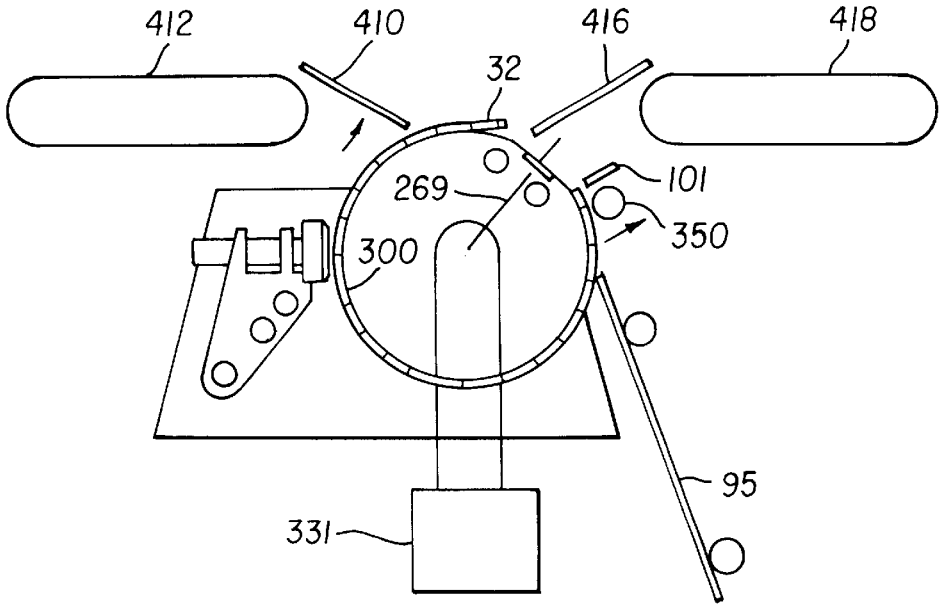

[19] The imaging drum is now rotated counterclockwise until approximately 1 inch of the leading edge of the donor sheet, which has raised up away from the flat on the surface of the imaging drum, engages the donor stripper blade, substantially as illustrated in FIG. 13*f*.

[20] The donor stripper blade 410 is then moved to its disengaged position, with the leading edge of the donor sheet supported thereon. The donor exit drive belt 412 is energized at this point.

[21] The valve actuator cam is moved to its inoperative position, reapplying vacuum to all of the vacuum chambers in the vacuum drum.

[22] The imaging drum 300 is rotated counterclockwise to completely strip the donor sheet 36 from superposition with the thermal print media sheet 32 and to drive it to the waste exit 414 of the apparatus (see FIG. 7).

The imaging drum is now ready for the superposition of the next donor sheet with the thermal print media material already registered thereon and containing a first image recorded from the first donor sheet. The second donor is then loaded onto the imaging drum by repeating Steps [8–15] from the above loading sequence, and the next image is written onto the thermal print media 32. That donor sheet is then removed according to, the foregoing unloading sequence of Steps [16–22]. This sequence continues, utilizing as many donor material sheets as the operator or program calls for. The apparatus is then ready to unload the receiver sheet bearing the finished image.

To unload the finished receiver, the following sequence is employed:

[23] The imaging drum 300 is stopped at the receiver unload position "D", as shown in FIG. 15.

[24] The valve actuator cam is engaged, which reduces vacuum in the imaging drum 300. This releases the trailing end of the thermal print media sheet 32, which is no longer held down by a superposed donor sheet 36, and the exit transport belt 412 and vacuum are activated.

Figure 13H:
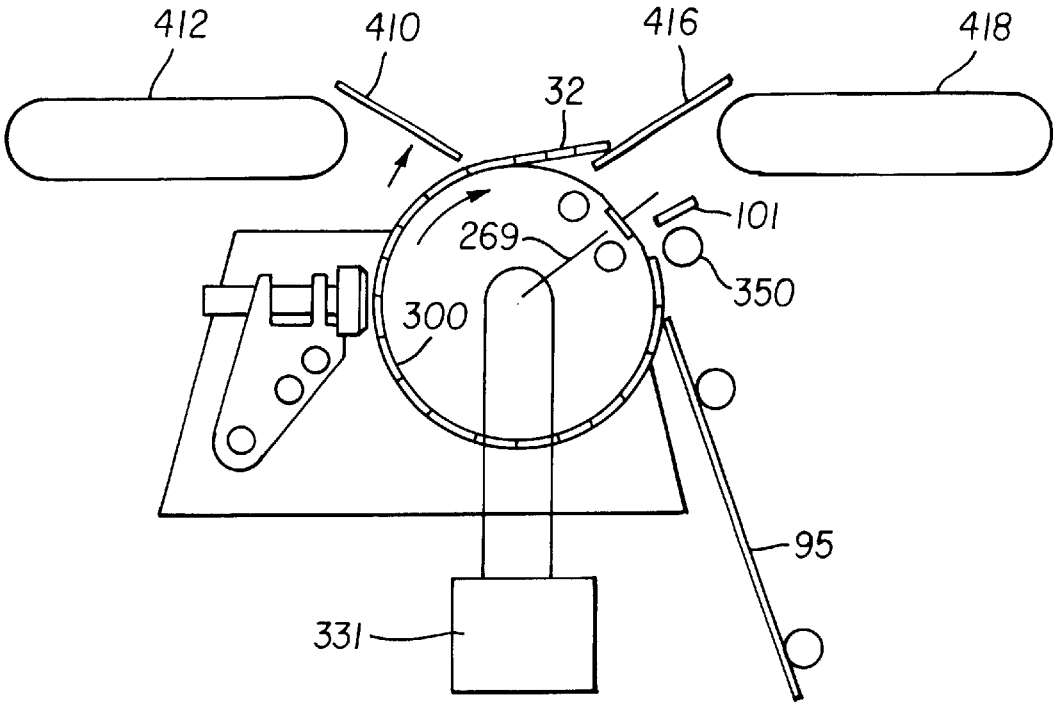

[25] The imaging drum 300 is rotated clockwise until the trailing end edge of the thermal print media sheet 32 is engaged by and lifted from the imaging drum 300 by the receiver sheet exit guide 416. The condition of the overall system at this point is illustrated in FIG. 13*h*.

[26] The valve actuating cam is disengaged, permitting vacuum to be reapplied to all of the imaging drum 300.

[27] The imaging drum 300 is rotated clockwise driving the thermal print media sheet 32 onto the receiver sheet exit guide on the receiver exit transport belt 412. Even though the vacuum has been reapplied to the imaging drum and the thermal print media sheet is being peeled from the surface of the imaging drum by the receiver sheet exit guide, the number of vacuum holes open to the atmosphere is progressively increasing as the thermal print media sheet is removed, so that less and less vacuum hold down is provided to the thermal print media sheet remaining on the imaging drum, with only an amount of vacuum remaining sufficient to retain the "leading" end of the thermal print media sheet in position until the imaging drum has rotated sufficiently that the entire thermal print media sheet has been removed therefrom. The finished thermal print media sheet is exited from the machine.

[28] The imaging drum 300 is then rotated counterclockwise to the "Home" position, the vacuum is turned off, and the apparatus is ready to generate the next proof.

A preferred process for loading thermal print media and/or donor material onto an imaging drum according to the present invention, then, includes the following steps:

a) rotating an imaging drum 300 in a first direction of rotation (see Step [2]);

b) actuating a sheet transport assembly 91 and driving a sheet of thermal print media 32 to the imaging drum 300 until a leading edge of the thermal print media sheet 32 engages the imaging drum 300, and then stopping the sheet transport assembly (see Step [3]);

c) rotating the imaging drum 300 in a second direction of rotation and stopping the imaging drum at a first media load position (see position "G" in FIG. 15 and Step [4]);

d) moving a magnetic load roller 350 into engagement with the leading edge of the thermal print media sheet 32 (see Step [6]);

e) rotating the imaging drum 300 in a second direction of rotation until a trailing edge of the thermal print media sheet 32 is under the magnetic load roller 350, and then stopping rotation of the imaging drum (see Step [7]); and f) moving the magnetic load roller 350 away from the imaging drum 300 (see Step [8]).

The process preferably includes a step g): repeating Steps a) through g) using a donor material 36. Steps subsequent to Step f) preferably include the following:

h) continuing to rotate the imaging drum 300, while actuating the sheet transport assembly 91 and driving a sheet of donor media 36 to the imaging drum 300 (see Steps [9, 11]);

i) stopping the imaging drum 300 at a donor sheet loading position (see position "H" in FIG. 15), and overlapping a leading edge of the donor sheet 36 onto the thermal print media sheet 32 (see Steps [9, 11]);

j) engaging the magnetic load roller 350 (see Step [13]);

k) rotating the imaging drum 300 in the second direction until a trailing edge of the donor sheet 36 is under the magnetic load roller 350 (see Step [14]); and 1) disengaging the magnetic load roller 350 from the imaging drum 300 (see Step [15]).

These steps, with slight modification, are also appropriate for embodiments of the present invention that do not include a drum flat or a sheet sensor. Where the imaging surface is an imaging drum, the first direction of rotation is preferably clockwise, and the second direction of rotation is preferably opposite to the first direction, and counterclockwise. Where the imaging surface in alternate embodiments is a platen, though, the second direction need not be counterclockwise, or even a direction opposite to the first direction. Movement, for example, may occur in a right or left direction, or in an up and down direction.

Preferably, Step (c) further comprises creating a vacuum in the vacuum drum, where the imaging drum is a vacuum drum.

Preferably, Step f) comprises rotating the imaging drum 300 until the magnetic load roller 350 contacts a row of magnets 395 in the imaging drum 300, and opposing magnetic forces between the load roller 350 and the magnets 395 in the drum push the magnetic load roller away from the media 32, 36 on the imaging drum to a more remote, disengaged position. Alternatively, the magnetic load roller 350 is mechanically pulled away from the imaging drum 300 to a disengaged position.

Preferably, in Step k) the donor media 36 is superposed on the thermal print media 32.

Preferably, Step l) comprises rotating the imaging drum 300 in the first direction, until the magnetic load roller 350 is disengaged by nearing at least one unload magnet 395 embedded in the surface of the imaging drum 300. Alternatively, Step l) comprises moving the magnetic load roller 350 to a disengaged position by motor-driven mechanical means (e.g., the linear drive motor drives an arm attached to the magnetic load roller). Step l) is preferably followed by Step m): accelerating the imaging drum 300 in a second direction to image writing speed and writing the image. Step m) is followed by Step n): removing the donor sheet 36 (see Steps [16–22] above), and Step o): unloading the finished thermal print media sheet 32 (see Steps [23–28] above).

Preferably, Step a) is preceded by the steps of: 1) rotating a carousel assembly 100 until a feed roll 48 of thermal print media material is adjacent to a sheet cutter assembly 82; 2) stopping the carousel assembly 100; 3) driving the media feed roll 48 and feeding an end of the feed roll into the sheet cutter assembly 82; 4) engaging the end of the media feed roll with a metering roll 86 and drive belt 88, and advancing the feed roll 48 until a predetermined length of thermal print media material is determined; and 5) actuating cutter blades 84 in the sheet cutter assembly 82 and cutting a thermal print media sheet from the media feed roll.

Preferably, Step h) is preceded by the steps of: (1) rotating the carousel 100 until a feed roll 48 of donor material is located adjacent to a sheet cutter assembly 82; (2) stopping the carousel 100 at a donor supply location; (3) driving the sheet feed roll 48, and feeding the end of a donor roll into the sheet cutter assembly; (4) engaging the end of the donor feed roll by the metering roll 86 and drive belt 88 until a pre-determined length of donor material is determined; and (5) actuating cutter blades 84 in the sheet cutter assembly 82, and cutting a donor sheet from the donor feed roll.

While the preferred embodiment has been described with respect to an apparatus that employs a rotating imaging drum, many of the features and advantages thereof can be incorporated in a process and apparatus employing a driven platen to carry the superposed thermal print media and donor materials.

While certain preferred operating conditions and ranges have been set forth above, it will be understood that the apparatus can use other operating conditions and ranges. For example, the writing laser diodes may operate with a variable power range of 160–500 mw each, at wavelengths in the range of 800–880 nm (nanometers), and the imaging drum can write at a resolution in the range of 1200–2400 dpi at speeds of 250–1200 rpm. While the focusing beam of the preferred embodiment preferentially has a wavelength of 960 nm, it will be appreciated that alternative wavelengths may be chosen so long as they are sufficiently different from the predominant wavelength of the writing beam as to be readily distinguishable therefrom.

A further alternative to the preferred embodiment may be found in the surface chosen from which to reflect the focus beam. While the reflective surface of the receiver element is preferred, it is possible to reflect the focus beam from the surface of the drum member, particularly if the receiver element is transparent, or if the imaging drum surface is particularly reflective. Other surfaces of the writing element may also be chosen as the surface from which to reflect the focus beam.

Additional variations in the present invention relate to the placement of the photodetector. For example it may be located outside, but adjacent to the writing head so that the reflected portion of the focusing beam need not pass through the focusing assembly. Further, it is possible to locate the photodetector behind a transparent surface of the support member so that it responds to the direct impingement of the focusing beam without requiring any reflection thereof.

Accordingly, the present invention provides a process and apparatus for consistently, quickly and accurately generating an image utilizing such an imaging process to create high quality, accurate, and consistent proof images, which process and apparatus is substantially automated to improve the control, quality and productivity of the proofing process while minimizing the attendance and labor necessary. Moreover, the writing apparatus is capable of not only generating this high quality image consistently, but is capable of creating a multi-color image which is in registration regardless of how the various individual images are supplied to the element comprising the final image. Thus, the present invention provides both a process and apparatus in which the various donor material sheets are sequentially superposed with a single thermal print media sheet and then removed.

The invention has been described in detail with particular reference to certain preferred embodiments thereof, but it will be understood that variations and modifications can be effected within the spirit and scope of the invention as described hereinabove and as defined in the appended claims by a person of ordinary skill in the art, without departing from the scope of the invention. While preferred embodiments of the invention have been described using specific terms, this description is for illustrative purposes only. It is intended that the doctrine of equivalents be relied upon to determine the fair scope of these claims in connection with any other person's product which fall outside the literal wording of these claims, but which in reality do not materially depart from this invention.

PARTS LIST

10. Image processing apparatus
12. Image processor housing
14. Image processor door
16. Donor ejection chute
18. Donor waste bin
20. Media stop
22. Waste sheet exit transport
24. Image sheet exit transport
26. Printer cabinet
30. Roll media
32. Thermal print media
34. Dye donor roll material
36. Dye donor sheet material
37. Carousel bearing
38. Vertical support
40. Vertical circular plate
42. Spindle
46. Material feed assembly
48. Driven roll
50. Sheet material trays
**50*a***. Lower sheet thermal print material tray
**50*b***. Upper sheet input image material tray
52. Media lift cams
**52*a***. Lower media lift cam
**52*b***. Upper media lift cam
54. Media rollers
**54*a***. Lower media roller
**54*b***. Upper media roller
56. Media guide
58. Media guide rollers
60. Media staging tray
64. Drive motor
66. Sheave
68. Sheave belt
70. Brake assembly
80. Transport mechanism
82. Sheet cutter assembly
84. Cutter blades
86. Material metering drum
88. Drive belt
90. Material supply assembly
91. Sheet transport assembly
92. Air chamber
94. Air table
95. Wire guides
99. Printhead assembly
100. Media carousel
101. Sheet sensor
102. Horizontal axis
103. Sheet transport rollers
104. Sheet drive rollers
110. Media drive mechanism
112. Media drive rollers
120. Media knife assembly
122. Media knife blades
198. Master lathe bed scanning engine
200. Lathe bed scanning subsystem
202. Lathe bed scanning frame
204. Entrance passageway
206. Rear translation bearing rod
208. Front translation bearing rod
210. Linear translation subsystem
220. Translation stage member
242. Protective sheath
250. Lead screw
252. Threaded shaft
254. Lead screw drive nut
258. Translator drive linear motor
260. Axial load magnets
**260*a***. Axial load magnet
**260*b*** Axial load magnet
262. Circular-shaped boss
264. Ball bearing
266. Circular-shaped insert

268. End cap
269. Centerline of drum flat
270. Hollowed-out center portion
272. Radial bearing
300. Imaging drum
302. Drum housing
304. Hollowed-out interior portion
306. Vacuum hole
308. Vacuum end plate
310. Drive end plate
312. Drive spindle
318. Vacuum spindle
320. Central vacuum opening
322. Axially extending flat
324. Donor support ring
326. Radial recess
331. Vacuum blower
332. Vacuum grooves
348. Inside wall of imaging drum
350. Magnetic load roller
352. Drum flat
360. Ferrous coating
370. Elastic layer
380. Magnetic layer
390. Load roller core
395. Magnet in unload position
400. Laser assembly
402. Laser diodes
404. Fiber optic cables
406. Distribution block
410. Stripper blade
412. Waste transport belt
414. Exit
416. Exit blade
418. Image sheet transfer belt
420. Vacuum table
422. Exit tray
454. Optical centerline
500. Printhead

What is claimed is:

1. An imaging apparatus for forming images on a print media, comprising:

an imaging head;

a magnet-attracting imaging surface;

print media removably mounted on the imaging surface, the imaging head being positioned to move over the print media on the imaging surface; and a movable, rotatable magnetic load roller engageable with the magnet-attracting imaging surface, with the removable print media between the two.

2. An image processing apparatus according to claim 1, wherein the imaging surface is a platen comprising a ferrous material.

3. An image processing apparatus according to claim 1, wherein the load roller comprises a plurality of magnets embedded in its surface.

4. An image processing apparatus according to claim 3, wherein the imaging apparatus is an ink jet printer.

5. An image processing apparatus according to claim 3, wherein the imaging surface is an imaging drum internally or externally coated with a ferromagnetic material, and the imaging drum further comprises a single unload magnet, or a single row of unload magnets extending along at least a portion of its length, with a polarity of the unload magnet opposing a polarity of a corresponding one of the plurality of magnets embedded in the load roller.

6. An imaging apparatus for forming images on a thermal print media, comprising:

a magnetic, rotatable imaging drum;

an imaging head which is movable along the longitudinal axis of the imaging drum at a speed synchronous with the rotation of the imaging drum;

thermal print media removably mounted on the imaging drum, the imaging head being positioned to systematically travel over the thermal print media on the imaging drum; and a movable, rotatable load roller coated with a ferrous material, the load roller being engageable with the magnetic imaging drum.

7. An image processing apparatus for writing images to a receiver media, the apparatus comprising:

a) a rotatable, magnet-attracting imaging drum mounted for rotation about an axis, the imaging drum being arranged to mount a receiver sheet and a donor sheet in superposed relationship thereon;

b) a linear drive motor for rotating the imaging drum;

c) a sheet transport assembly for transporting the receiver and donor sheets to the imaging drum;

d) a printhead which is movable along the imaging drum;

e) a lead screw for moving the printhead in a first direction, the printhead being mounted on the lead screw;

f) a linear translation subsystem on which the printhead, imaging drum, and lead screw are mounted; and g) a magnetic load roller engageable with the magnet-attracting imaging drum.

8. An image processing apparatus according to claim 7, wherein the imaging drum comprises a ferrous material.

9. An image processing apparatus according to claim 8 wherein the image processing apparatus is a laser thermal printer.

10. An image processing apparatus according to claim 7, wherein the imaging drum is coated with a ferrous material.

11. An image processing apparatus according to claim 10, wherein the receiver sheet is a thermal print media sheet.

12. An image processing apparatus according to claim 11, wherein the load roller is made of a magnetic material.

13. An image processing apparatus according to claim 11, wherein the load roller comprises a plurality of magnets embedded in its surface.

14. An image processing apparatus according to claim 7 wherein the image processing apparatus is a film writer.

15. An image processing apparatus according to claim 14, wherein the magnetic load roller is coated with stainless steel.

16. An image processing apparatus according to claim 7, wherein the load roller is plasma coated with a ferromagnetic coating.

17. An image processing apparatus according to claim 7, wherein the magnetic load roller comprises an exterior elastomeric layer.

18. An image processing apparatus according to claim 17, wherein the magnetic load roller comprises a magnetic middle layer.

19. An image processing apparatus according to claim 18, wherein the magnetic load roller comprises a steel core.

20. An image processing apparatus according to claim 7, wherein the imaging drum further comprises a single row of unload magnets along at least a portion of its length.

21. An image processing apparatus according to claim 20, wherein the magnetic load roller comprises three layers: an exterior elastomeric layer surrounding a magnetic middle layer, the middle magnetic layer surrounding a steel core.

22. An image processing apparatus according to claim 21 wherein the image processing apparatus is a laser thermal film writer.

23. An image processing apparatus according to claim 7, wherein the imaging drum further comprises a magnetic strip along its length.

24. An image processing apparatus according to claim 23, wherein the imaging drum is a vacuum imaging drum comprising a radial recess with a depth substantially equal to the thickness of the thermal print media.

25. An image producing process for loading thermal print media or donor material on an imaging drum, comprising the steps of:

a) rotating a magnet-attracting imaging drum in a first direction of rotation;

b) actuating a sheet transport assembly and driving a sheet of thermal print media to the imaging drum until a leading edge of the thermal print media sheet engages the imaging drum, and then stopping the sheet transport assembly;

c) rotating the imaging drum in a second direction of rotation and stopping the imaging drum at a first media load position;

d) moving a magnetic load roller into engagement with the leading edge of the thermal print media sheet on the magnet-attracting imaging drum;

e) rotating the imaging drum in the second direction of rotation until a trailing edge of the thermal print media sheet is under the magnetic load roller, and then stopping rotation of the imaging drum; and f) moving the magnetic load roller away from the imaging drum.

26. An image producing process according to claim 25, further comprising Step g): repeating Steps a) through f) using a donor material.

27. An image producing process according to claim 25, wherein Step e) comprises rotating the imaging drum until the magnetic load roller contacts a row of magnets in the imaging drum, and opposing magnetic forces between the magnetic load roller and the row of magnets in the imaging drum force the magnetic load roller away from the imaging drum.

28. An image producing process according to claim 25, wherein Step f) comprises mechanically pulling the magnetic load roller away from the imaging drum to a disengaged position.

29. An image producing process according to claim 25, further comprising the steps of:

h) continuing to rotate the imaging drum, while actuating the sheet transport assembly and driving a sheet of donor media to the imaging drum;

i) stopping the imaging drum at a donor sheet loading position, and overlapping a leading edge of the donor sheet onto the thermal print media sheet;

j) engaging the magnetic load roller against the imaging drum;

k) rotating the imaging drum in the second direction until a trailing edge of the donor sheet is under the magnetic load roller; and l) disengaging the magnetic load roller from the imaging drum.

30. An image producing process according to claim 29, wherein Step l) comprises rotating the imaging drum until the magnetic load roller is disengaged by encountering at least one unload magnet embedded in the surface of the imaging drum.

31. An image producing process according to claim 30, further comprising the following steps prior to Step h):

(1) rotating a carousel until a feed roll of donor material is adjacent to a sheet cutter assembly;

(2) stopping the carousel at a donor supply location;

(3) driving the feed roll, and feeding an end of the donor feed roll into the sheet cutter assembly;

(4) engaging the end of the donor feed roll by a metering roll and drive belt until a pre-determined length of donor material is determined; and (5) actuating cutter blades in the sheet cutter assembly, and cutting a donor sheet from the donor feed roll.

32. An image producing process according to claim 29, wherein Step l) comprises moving the magnetic load roller to a disengaged position by motor-driven mechanical means.

33. An image producing process according to claim 29, wherein Step l) is followed by Step m): accelerating the imaging drum in the second direction to image writing speed and writing the image.

34. An image producing process according to claim 32, wherein Step m) is followed by Step n): removing the donor sheet, and Step o): unloading the finished thermal print media sheet.

35. An image producing process according to claim 34, wherein the first direction of rotation is clockwise, and the second direction is counterclockwise.

36. An image producing process according to claim 25, wherein Step a) is preceded by the steps of:

(1) rotating a carousel assembly until a feed roll of thermal print media material is adjacent to a sheet cutter assembly;

(2) stopping the carousel assembly;

(3) driving the media feed roll and feeding an end of the media feed roll into the sheet cutter assembly;

(4) engaging the end of the media feed roll with a metering roll and drive belt, and advancing the roll until a pre-determined length of thermal print media material is determined; and (5) actuating cutter blades in the sheet cutter assembly and cutting a thermal print media sheet from the media feed roll.

* * * * *